US008485653B2

(12) United States Patent
Katsuyama et al.

(10) Patent No.: US 8,485,653 B2
(45) **Date of Patent: *Jul. 16, 2013**

(54) COMPACT FRONT-OPERABLE IMAGE FORMING APPARATUS

(75) Inventors: Goro Katsuyama, Kanagawa (JP); Masaaki Kabumoto, Chiba (JP); Kanae Amemiya, Tokyo (JP); Osamu Miki, Kanagawa (JP); Hideo Aoki, Kanagawa (JP); Akiyoshi Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/210,794

(22) Filed: Aug. 16, 2011

(65) Prior Publication Data

US 2011/0298873 A1 Dec. 8, 2011

Related U.S. Application Data

(63) Continuation of application No. 12/272,480, filed on Nov. 17, 2008, now Pat. No. 8,152,294, which is a continuation of application No. 10/536,741, filed as application No. PCT/JP03/15439 on Dec. 2, 2003, now Pat. No. 7,469,981.

(30) Foreign Application Priority Data

Dec. 4, 2002 (JP) ..... 2002-351942
Jan. 6, 2003 (JP) ..... 2003-000036
Nov. 18, 2003 (JP) ..... 2003-387446

(51) Int. Cl.
*B41J 2/17* (2006.01)
*B41J 2/175* (2006.01)

(52) U.S. Cl.
USPC ..... 347/86; 347/84; 347/85

(58) Field of Classification Search
None
See application file for complete search history.

(56) References Cited

U.S. PATENT DOCUMENTS 4,698,650 A * 10/1987 Watanabe et al. ..... 346/134
4,728,963 A 3/1988 Rasmussen et al.
4,926,196 A 5/1990 Mizoguchi et al.
5,138,344 A 8/1992 Ujita (Continued)

FOREIGN PATENT DOCUMENTS

CN 1017509 B 7/1992
CN 1021313 C 6/1993

(Continued)

OTHER PUBLICATIONS

Nov. 16, 2006 Japanese official action in Japanese patent application No. 2003-387446.

(Continued)

*Primary Examiner* — Matthew Luu
*Assistant Examiner* — Kendrick Liu
(74) *Attorney, Agent, or Firm* — Cooper & Dunham LLP

(57) ABSTRACT

An image forming apparatus is disclosed that includes a substantially flat top face and a slanted front face, the bottom side of which recedes backward. The image forming apparatus may includes a paper discharge tray disposed at a lower portion of the slanted front face, the paper discharge tray protruding forward. The paper discharge tray may be tiltable upward and downward. Because the bottom side of the slanted front face recedes backward, the flat top face can be provided, and simultaneously, enough space for the feeding and discharging of paper can be secured.

7 Claims, 49 Drawing Sheets

U.S. PATENT DOCUMENTS

| | | | | |
|---|---|---|---|---|
| 5,559,609 | A | 9/1996 | Yamada et al. | |
| 5,920,758 | A | 7/1999 | Ohtsuki | |
| 6,152,630 | A | 11/2000 | Scarton et al. | |
| 6,325,503 | B1 | 12/2001 | McCue, Jr. et al. | |
| 6,378,984 | B1 * | 4/2002 | Steinfield et al. | 347/47 |
| 6,382,617 | B1 | 5/2002 | Yen et al. | |
| 6,409,166 | B1 | 6/2002 | Kashimura | |
| 6,533,383 | B1 * | 3/2003 | Saruta et al. | 347/19 |
| 6,830,401 | B1 | 12/2004 | Hwang et al. | |
| 6,914,698 | B1 | 7/2005 | Hunter | |
| 7,552,998 | B2 * | 6/2009 | Yonekawa et al. | 347/49 |
| 2001/0026724 | A1 * | 10/2001 | Endo et al. | 400/691 |
| 2002/0043910 | A1 | 4/2002 | Hashimoto et al. | |
| 2002/0093556 | A1 | 7/2002 | Ishizawa et al. | |
| 2003/0035040 | A1 | 2/2003 | Hwang | |
| 2003/0052956 | A1 | 3/2003 | Katsuyama | |
| 2003/0081104 | A1 | 5/2003 | Dwyer et al. | |
| 2004/0056941 | A1 | 3/2004 | Hwang | |

FOREIGN PATENT DOCUMENTS

| | | | |
|---|---|---|---|
| EP | 0534500 | A2 | 3/1993 |
| JP | 63-160846 | | 7/1988 |
| JP | 63-239073 | | 10/1988 |
| JP | 2-132020 | | 5/1990 |
| JP | 3-140975 | | 6/1991 |
| JP | 4-5894 | | 1/1992 |
| JP | 05-2500 | | 1/1993 |
| JP | 6-64761 | | 3/1994 |
| JP | 6-198990 | | 7/1994 |
| JP | 10-119388 | | 5/1998 |
| JP | 10-202900 | | 8/1998 |
| JP | 11-78159 | | 3/1999 |
| JP | 11-84797 | | 3/1999 |
| JP | 11-151841 | | 6/1999 |
| JP | 11-193167 | | 7/1999 |
| JP | 11-254788 | | 9/1999 |
| JP | 2001-130093 | | 5/2001 |
| JP | 2001-312112 | | 11/2001 |
| JP | 2002-62705 | | 2/2002 |
| JP | 3326781 | | 7/2002 |

OTHER PUBLICATIONS

May 18, 2007 official action in connection with Chinese Patent Application No. 2003801087924.

Feb. 24, 2009 Japanese official action in connection with counterpart Japanese patent application No. 2007-002005.

May 27, 2009 Japanese official action in connection with counterpart Japanese patent application No. 2007-002005.

Dec. 25, 2009 Chinese official action (with English translation) in connection with counterpart Chinese patent application No. 200301087924.

Feb. 16, 2010 Japanese official action in connection with counterpart Japanese patent application No. 2003-387446.

* cited by examiner

COMPACT FRONT-OPERABLE IMAGE FORMING APPARATUS

CROSS-REFERENCE TO RELATED APPLICATIONS

This application is a Rule 1.53(b) continuation of U.S. application Ser. No. 12/272,480, filed Nov. 17, 2008, which in turn is a continuation of U.S. application Ser. No. 10/536,741, filed May 27, 2005, now U.S. Pat. No. 7,469,981, which in turn is a U.S. national phase application under 35 U.S.C. 371 of International Application No. PCT/JP2003/015439 filed Dec. 2, 2003.

TECHNICAL FIELD

The present invention generally relates to an image forming apparatus, and more particularly, to a useful compact front-operable image forming apparatus and a paper discharge tray of the same.

BACKGROUND ART

Image forming apparatuses includes printers, facsimile machines, and copiers, for example.

Ink jet image forming apparatuses (ink jet recording apparatuses) are known as a kind of image forming apparatus. The ink jet recording apparatus records images on a recording medium such as paper and transparent plastic sheets for OHP, by discharging ink droplets from a recording head thereof. The advantages of the ink jet recording apparatus include low running cost, low noise, and easy color printing using multiple color inks.

Electrophotography image forming apparatuses are known as another kind of image forming apparatus. The electrophotography image forming apparatus forms toner images on a photosensitive unit using a charging unit, an exposure unit, and development unit, for example; transfers the toner images on the recording medium using a transfer unit; and fixes the transferred toner images using a fixing unit.

Japanese Patent Laid-Open Application No. 11-151841 discloses a conventional image forming apparatus in which a paper cassette is loaded from the front of the image forming apparatus and paper is fed from the rear of the image forming apparatus. After an image is formed on the paper, the paper is discharged into a paper discharge tray at the rear of the image forming apparatus. In another conventional image forming apparatus, paper is fed from a paper feed tray loaded at the rear of the image forming apparatus, and the paper is discharged into the paper discharge tray at the front of the image forming apparatus.

Such image forming apparatuses are widely used both in small offices and at home where space for the image forming apparatus is limited. The image forming apparatus may be disposed on a desk or in a rack.

According to the limitation of the space, the image forming apparatus is preferably made compact. Contradictorily, the top face of the image forming apparatus is preferably made wide and flat so that a user can place something thereon.

However, if the top face of the image forming apparatus is simply made wide and flat, the top face may give a negative visual impression to the user. If the top face of the image forming apparatus is simply made wide, the loading of the paper feed tray and the handling of paper discharged into the paper discharge tray may become difficult. The operability of the image forming apparatus may be degraded. Otherwise, the paper discharge tray and/or the paper feed tray may greatly protrude from the image forming apparatus body. The footprint of the image forming apparatus may be increased.

If operations keys and displays are provided on the top face, it becomes difficult to use the top face effectively, even if the top face is made large. Additionally, if the top face of the image forming apparatus body is made flat, the user can place something thereon. However, it is not cost-effective to design the image forming apparatus body to support heavy weight.

As described above, the footprint of the image forming apparatus is preferably small. However, if paper is fed from the rear and discharged to the front of the image forming apparatus, even if the image forming apparatus body is made compact, the total system becomes considerably larger. It would be difficult to dispose it on a desk or in a rack.

In the case of the conventional image forming apparatus disclosed in the above Japanese Patent Laid-Open Application No. 11-151841 in which the paper feed tray and the paper discharge tray are disposed at the same side, its total space may become small. However, the paper feed tray (paper cassette) needs to be loaded from the opposite direction in which paper is fed. Accordingly, a large space is required in front of and in rear of the image forming apparatus so as to handle (load and remove) the paper feed cassette. It is difficult to dispose the image forming apparatus on a desk or in a rack.

According to the above problems, it is preferred that the paper feed tray be loaded at the front of the image forming apparatus, and the paper be fed from the lower front, reversed in the image forming apparatus, and discharged to the upper front of the image forming apparatus. In this case, the paper feed tray is positioned under the paper discharge tray. It becomes difficult to handle the paper feed tray while replenishing with paper.

If the total height of the image forming apparatus needs to be reduced, the paper needs to be reversed at a short radius in the image forming apparatus, especially in the case of the ink jet recording apparatus. The paper discharge tray needs to be disposed to some extent below the opening through which paper is discharged so that a large amount of paper can be stacked in the paper discharge tray. In addition, it is effective to transport paper to its width direction to make the depth of the image forming apparatus short and to make the speed of print operation fast.

However, if paper is reversed at a short radius, the paper tends to roll up in the transport directions, which may make the discharging of the paper difficult. Likewise, if the paper discharge tray is disposed below the opening to some extent, the paper drops in the paper discharge tray with its top rolled up due to its weight, which makes the discharging of the paper difficult. The forming of images on paper using ink droplets makes the paper easily roll up. The rolling up of the paper may be increased by the effect of the direction of fibers forming the paper.

Furthermore, it is desired that not only the feeding and discharging of paper but also the ink cartridges, power switch, connection with the PC, and power cable, for example, be accessible from the front in order to improve the operability of the image forming apparatus.

It is also preferable that accessories such as a manual, a USB cable, preparative inks, and installation disks be stored in the image forming apparatus so as to avoid losing them.

DISCLOSURE OF THE INVENTION

It is a general object of the present invention to provide a novel and useful image forming apparatus in which one or more of the above problems are eliminated.

A more specific object of the present invention is to provide an image forming apparatus with a relatively wide flat top face that discharges and is fed paper in the front. Another object of the present invention is to provide an image forming apparatus with a relatively wide flat top face that looks more compact than it actually is. Yet another specific object of the present invention is to provide an image forming apparatus that can be easily replenished with paper. Yet another object of the present invention is to provide an image forming apparatus that can smoothly discharge paper. Yet another object of the present invention is to provide an image forming apparatus that is operable without increasing the footprint thereof.

To achieve one or more of the above objects, an image forming apparatus according to an aspect of the present invention includes a substantially flat top face and a slanted front face, the bottom side of which recedes backward.

Because the bottom side of the slanted front face recedes backward, the flat top face can be provided, and simultaneously, enough space for the feeding and discharging of paper can be provided.

The image forming apparatus may include a paper discharge tray disposed at a lower portion of the slanted front face, the paper discharge tray protruding forward. The paper discharge tray may be tiltable upward and downward.

The image forming apparatus may further include a paper feed tray disposed at a lower portion of the slanted front face, the paper feed tray protruding forward.

An image forming apparatus according to another aspect of the present invention may include a substantially flat top face that is visibly divided. The division is may be realized by a stripe-shaped dividing element formed on said top face that divides said top face into a front portion and a rear portion, or a step formed on said top face, wherein said step divides said top face into a front portion and a rear portion.

The image forming apparatus looks more compact than it actually is as a result of the division.

An image forming apparatus according to yet another aspect of the present invention may include: a paper feed tray that applies pressure to paper stacked therein for feeding the paper; a paper discharge tray for stacking paper on which an image is formed, wherein said paper discharge tray is tiltable bidirectionally; and a release mechanism that, when said paper discharge tray is tilted, releases the pressure applied to the paper stacked in said paper feed tray.

When the paper discharge tray is lifted up, the release mechanism releases the paper feed tray, and the paper feed tray is pushed out of the apparatus body. The release mechanism improves the operability of the image forming apparatus.

According to yet another aspect of the present invention, a paper discharge tray in which paper discharged from an apparatus body is stacked includes a slope on which the paper is stacked, a first side of said slope being higher than a second side of said slope, wherein the first side is in the downstream direction in which the paper is discharged.

The slope formed in the paper discharge tray makes the discharging of paper from the apparatus body smooth.

An image forming apparatus according to yet another aspect of the present invention includes: an image forming unit for forming an image on paper; a detachable transport cover provided on a rear side of the image forming apparatus for covering a mechanism of said image forming unit; and a storage unit formed on said detachable transport cover for storing miscellaneous objects.

Since the transport cover is detachable and has the storage unit formed thereon, the image forming apparatus can store miscellaneous objects therein without increasing its footprint.

Other objects, features, and advantages of the present invention will become more apparent from the following detailed description when read in conjunction with the accompanying drawings.

BEST MODE FOR CARRYING OUT THE INVENTION

A description of the embodiments of the present invention is given below with reference to the drawings.

Figure 1:
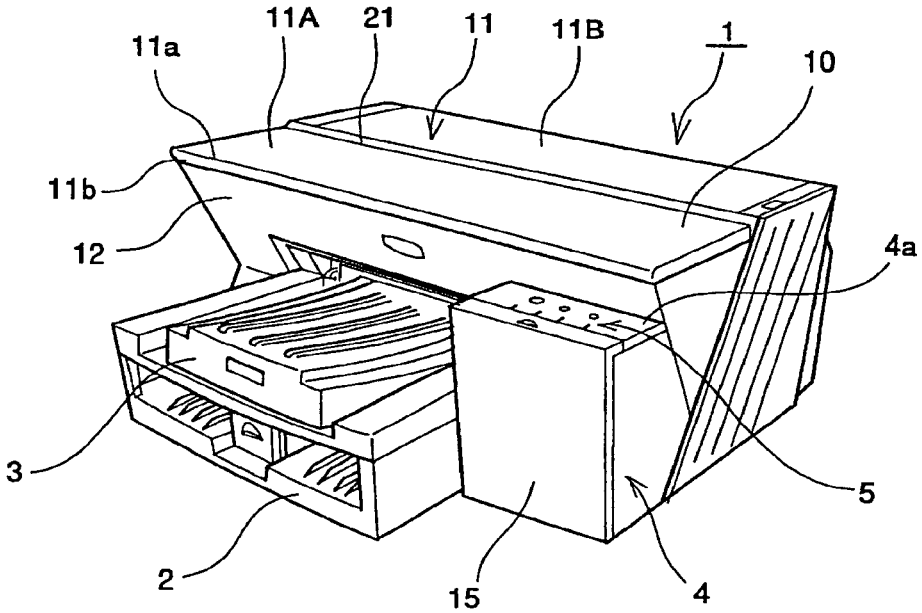
FIG. 1 is a front perspective view of an ink jet recording apparatus according to an embodiment.
Figure 2A:
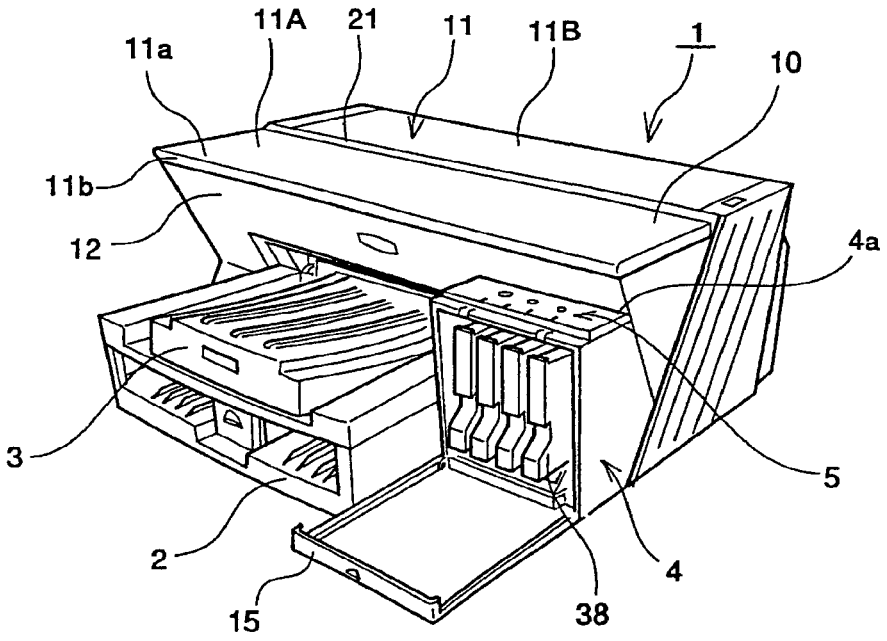
FIG. 2A is a front perspective view of the ink jet recording apparatus with the cover of its ink cartridge loading unit open.
Figure 2B:
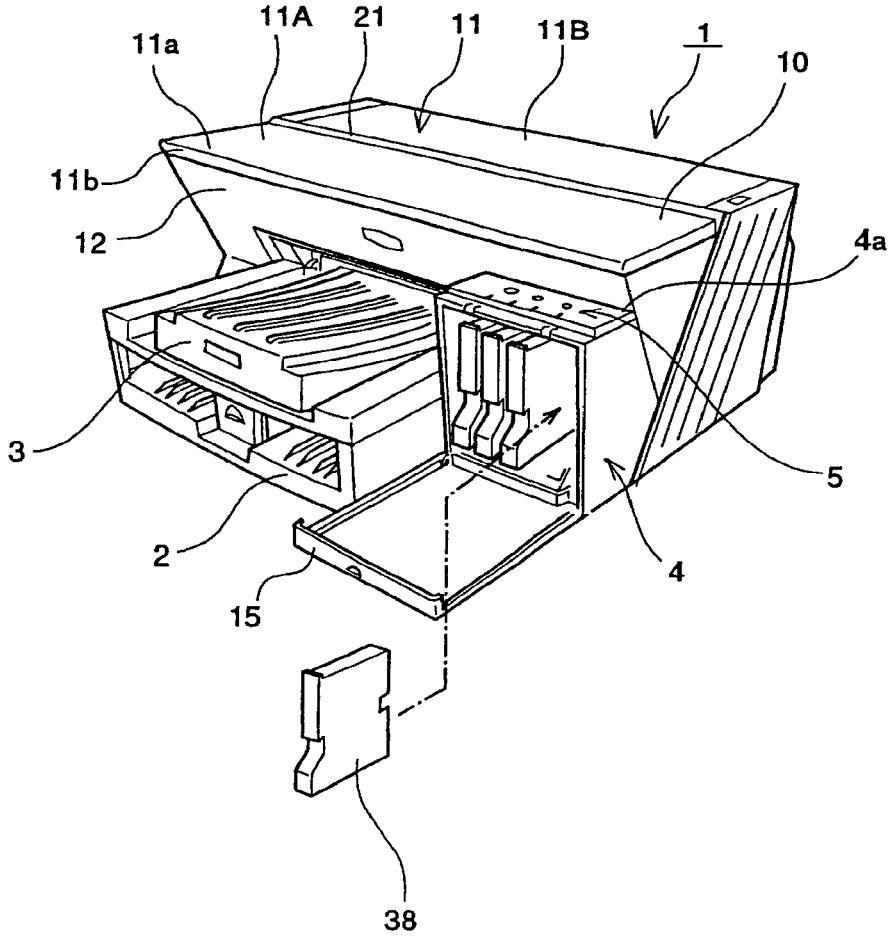
FIG. 2B is a front perspective view of the ink jet recording apparatus for explaining the loading of an ink cartridge.
Figure 3:
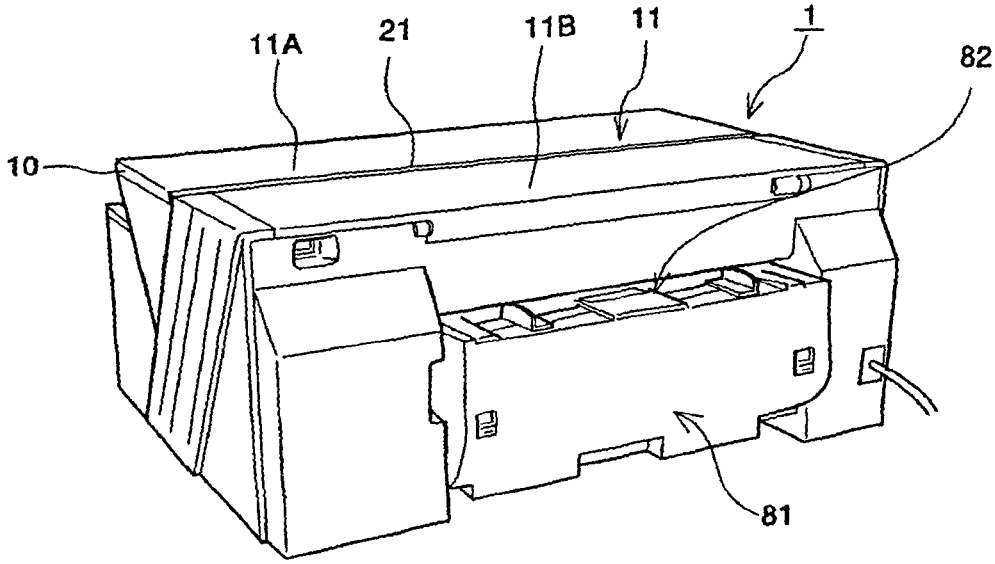
FIG. 3 is a rear perspective view of the ink jet recording apparatus.
Figure 4:
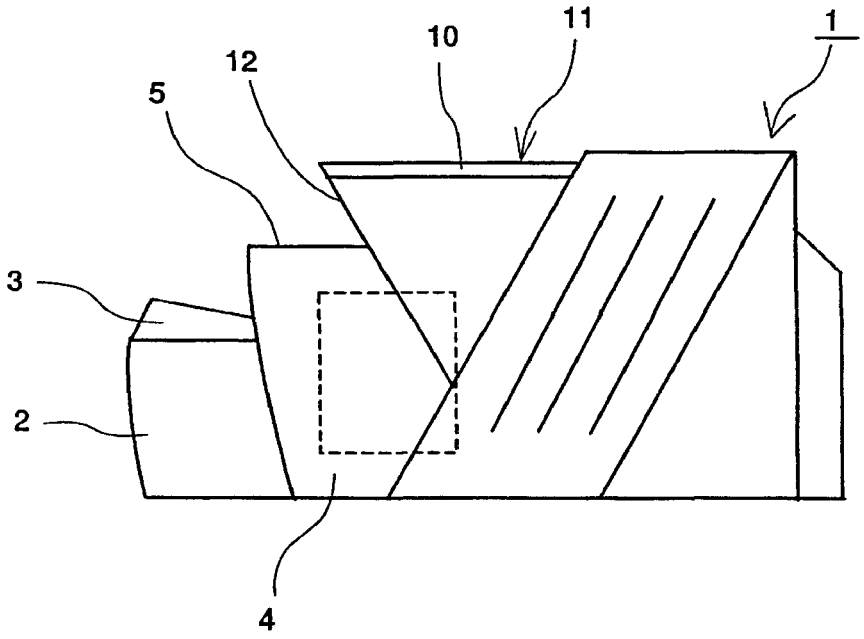
FIG. 4 is a side view of the ink jet recording apparatus.

FIG. 1 is a perspective view showing from front an ink jet recording apparatus including a paper discharge tray according to an embodiment. FIG. 2A is a perspective view showing the ink jet recording apparatus according to the embodiment with its ink cartridge loading unit open. FIG. 2B is a perspective view showing the ink jet recording apparatus according to the embodiment for explaining the loading of an ink cartridge. FIG. 3 is a perspective view showing from the rear the ink jet recording apparatus according to the embodiment.

The ink jet recording apparatus includes an apparatus body 1, a paper feed tray 2, and a paper discharge tray 3. The paper feed tray 2 is loaded on the apparatus body 1 and feeds paper. The paper discharge tray 3 is also loaded on the apparatus body 1, and paper on which images are formed is stacked on the paper discharge tray 3.

The top face 11 of the apparatus body 1 is formed by an upper cover 10 that can be opened and closed. The top face 11 is substantially flat. The front face 12 of the apparatus body 1 is formed by a front cover. The front face 12 slants backward from the front edge of the top face 11.

Because the front face 12 of the apparatus body 1 slants backward from the front edge of the top face 11, the top face 11 can be extended toward the front of the apparatus body 1. According to this arrangement, the top face 11 becomes large but the apparatus body 1 looks smaller than it actually is.

Figure 6:
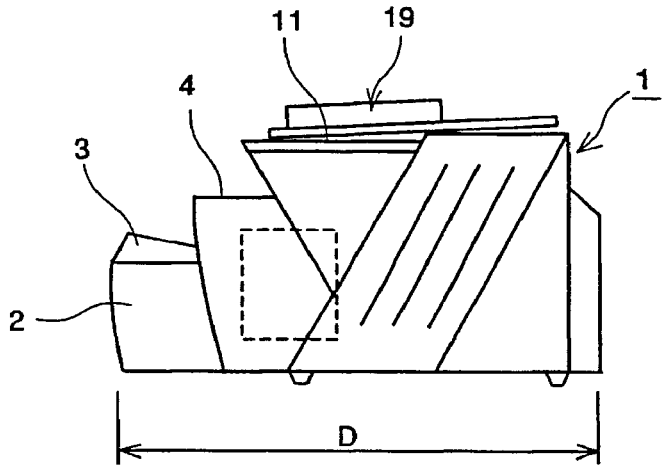
FIG. 6 is a schematic diagram for explaining another exemplary use form of the ink jet recording apparatus.

The paper discharge tray 3 and the paper feed tray 2 protrude at a lower position of the slanted front face 12. Because the front face 12 slants and the lower portion thereof recedes backward, the total depth D (FIG. 6) of the system including the paper feed tray 2 and the paper discharge tray 3 becomes short.

According to this arrangement, a large portion of the paper discharge tray 3 becomes visible to the user. The user can easily handle paper discharged in the paper discharge tray 3 and check images formed on the paper. The replenishing of paper to the paper feed tray 2 becomes easy, and a side guide provided to the paper feed tray 2 becomes easy to handle.

Additionally, the apparatus body 1 includes the cartridge loading unit 4 at a side of the front face 12, the cartridge loading unit 4 protruding forward. An operations unit 5 including operational keys and a display unit is provided on a top face 4*a* of the cartridge loading unit 4. An openable front cover 15 is provided to the cartridge loading unit 4 for loading and unloading an ink cartridge 38 (recording liquid cartridge).

Figure 5:
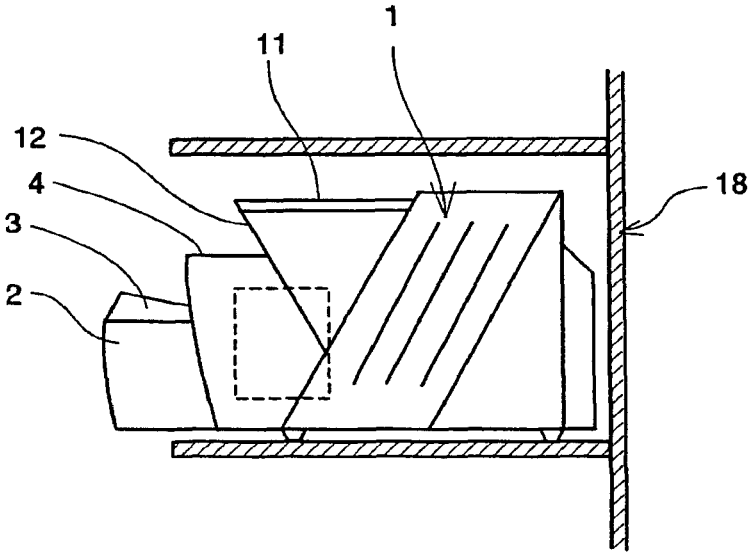
FIG. 5 is a schematic diagram for explaining an exemplary use form of the ink jet recording apparatus.

Since the operations unit is provided on the top face 4*a* of the cartridge loading unit 4, the user can use the substantially flat top face 11 efficiently. Even if the image forming apparatus is disposed on a rack 18 as shown in FIG. 5, the user can easily operate the operations unit 5 and see the display unit therein. The user can load and unload the ink cartridge 38 from the front of the image forming apparatus. Accordingly, the operability of the image forming apparatus is improved.

Furthermore, the top cover 10 of the apparatus body 1 including the front edge portion 11*a* of the top face 11 can be entirely opened. The front face of the front edge portion 11*a* is cut with a slant to be flush with and in the plane of the slanted front face 12. According to this arrangement, the users can easily open the top cover 10 using their fingers.

A step 21 is formed substantially at the middle of the substantially flat top face 11 (the top face of the top cover 10) of the apparatus body 1. The top face 11 is separated into a top face front 11A and a top face rear 11B.

The separating of the top face 11 causes various mental effects in the users. It causes the users to feel as if the depth of the apparatus body 1 is short. The separating of the top face 11 also causes the users not to place a heavy object thereon, and prevents the top face 11 from being broken.

The separating of the top face 11 with the step 21 also physically strengthens the top cover 10. Since the top face front 11A is below the top face rear 11B, the user feels as if the total height of the apparatus body 1 is low.

According to this embodiment, the top face 11 is separated into the front portion and the rear portion by the step 21. According to another embodiment shown in FIG. 7, the top face 11 may be separated into the top face front 11A and the top face rear 11B by coloring them with different colors instead of forming the step 21.

Figure 8:
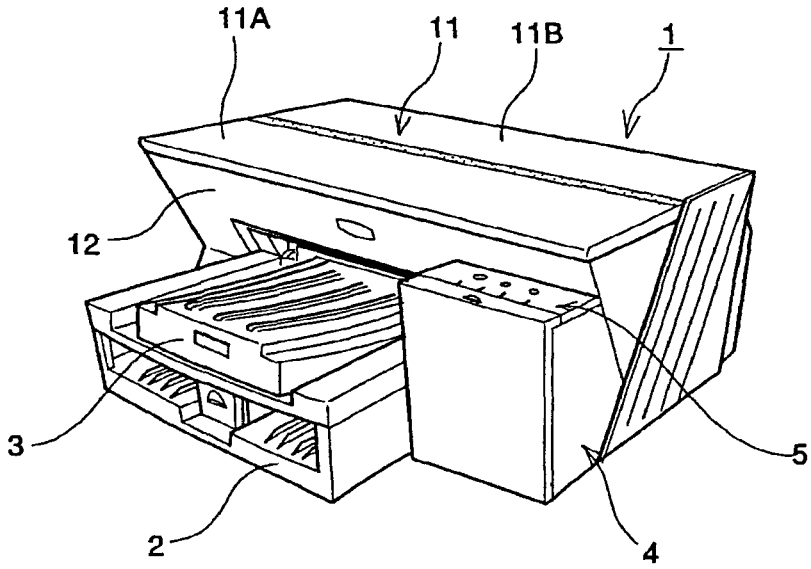
FIG. 8 is a perspective view for explaining another exemplary top face of the ink jet recording apparatus.

According to yet another embodiment shown in FIG. 8, a color band 22 is formed on the top face 11 to separate it into the front portion and the rear portion. According to yet another embodiment (not shown), a convex bump of a small height may be formed on the top face 11 to separate it into the front portion and the rear portion. The image forming apparatuses according to these embodiments pose the same mental effects in the users.

Figure 7:
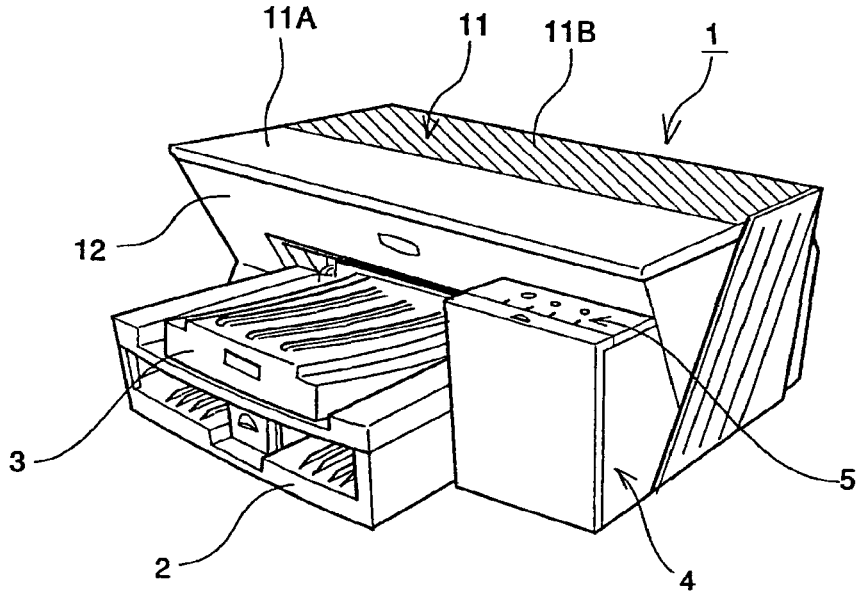
FIG. 7 is a perspective view for explaining an exemplary top face of the ink jet recording apparatus.

The image forming apparatuses shown in FIGS. 7 and 8 do not have a step that divides the top face 11. According to this arrangement, the entire top face 11 becomes flat (fully flat). When the user places an object on the top face 11 of the apparatus body 1, the object stands upright.

Figure 9:
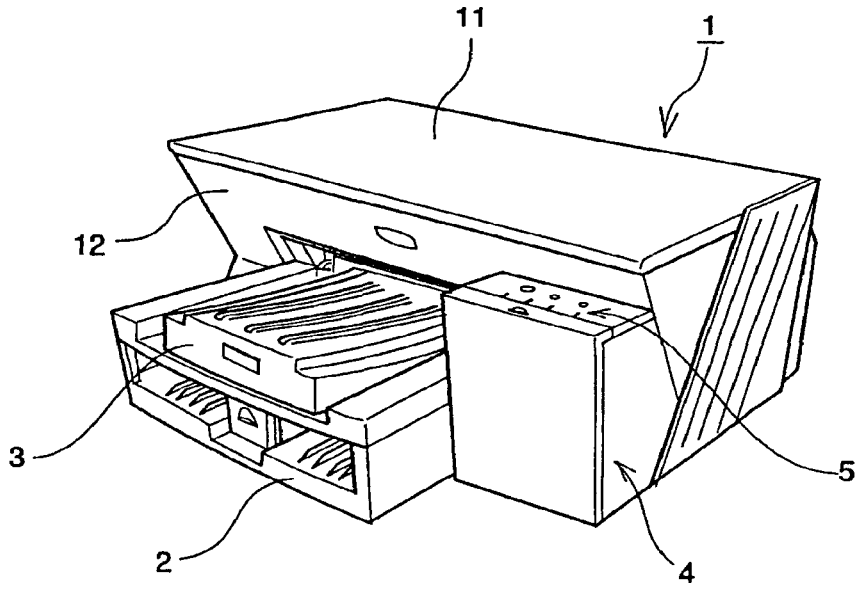
FIG. 9 is a perspective view for explaining yet another exemplary top face of the ink jet recording apparatus.

According to yet another embodiment as shown in FIG. 9, the top face 11 of the apparatus body 1 may be made fully flat without dividing the top face 11 even visibly (by coloring the top face 11 with different colors as shown in FIG. 7 or forming a color line as shown in FIG. 8). In this case, the users can put objects on the top face 11, or easily handle the paper cassette and discharged paper in the paper discharge tray. The users also can easily operate the operations unit 5 and see the display unit therein.

Figure 10A:
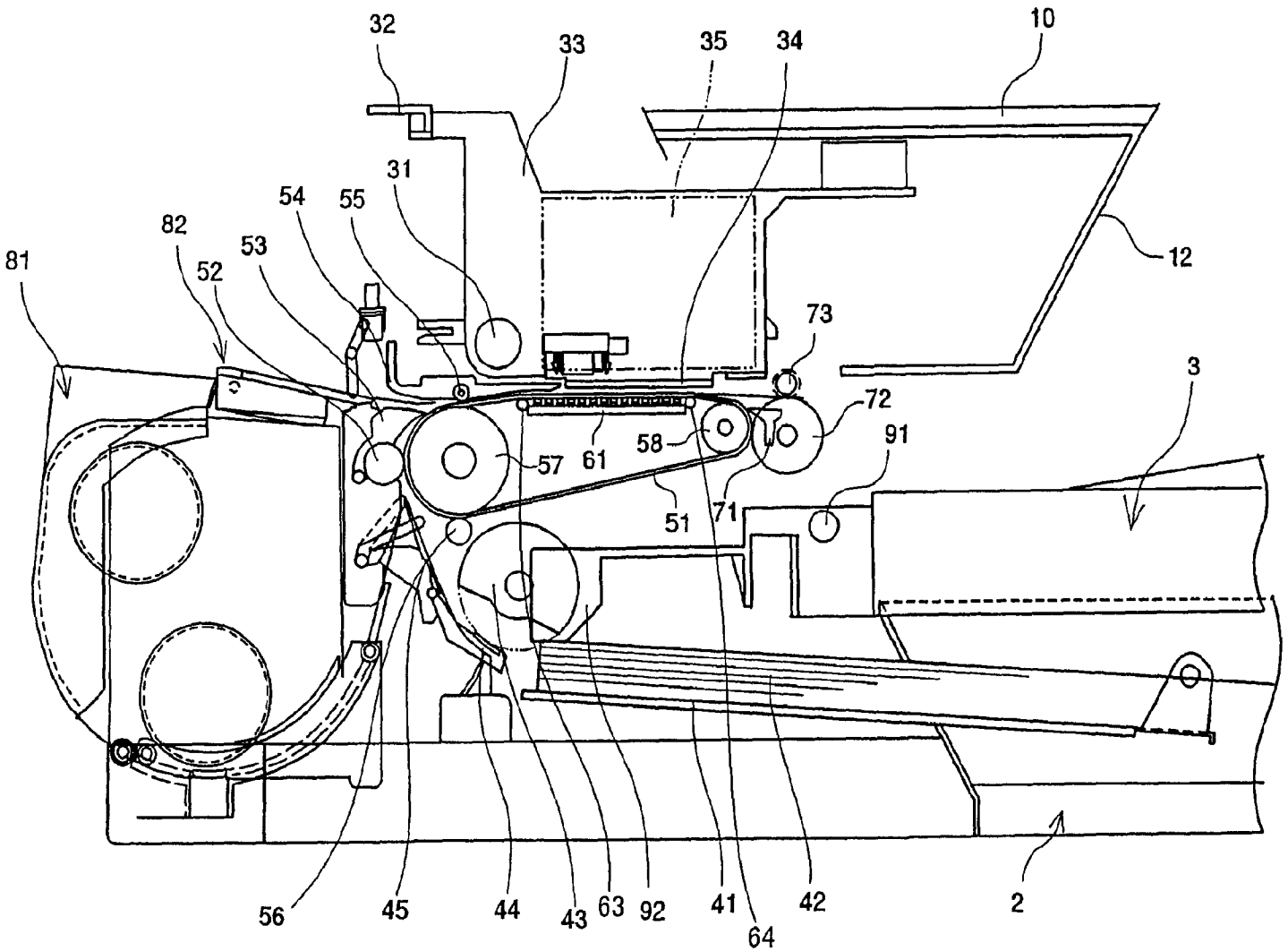
FIG. 10A is a side view showing the mechanism of the ink jet recording apparatus.
Figure 10B:
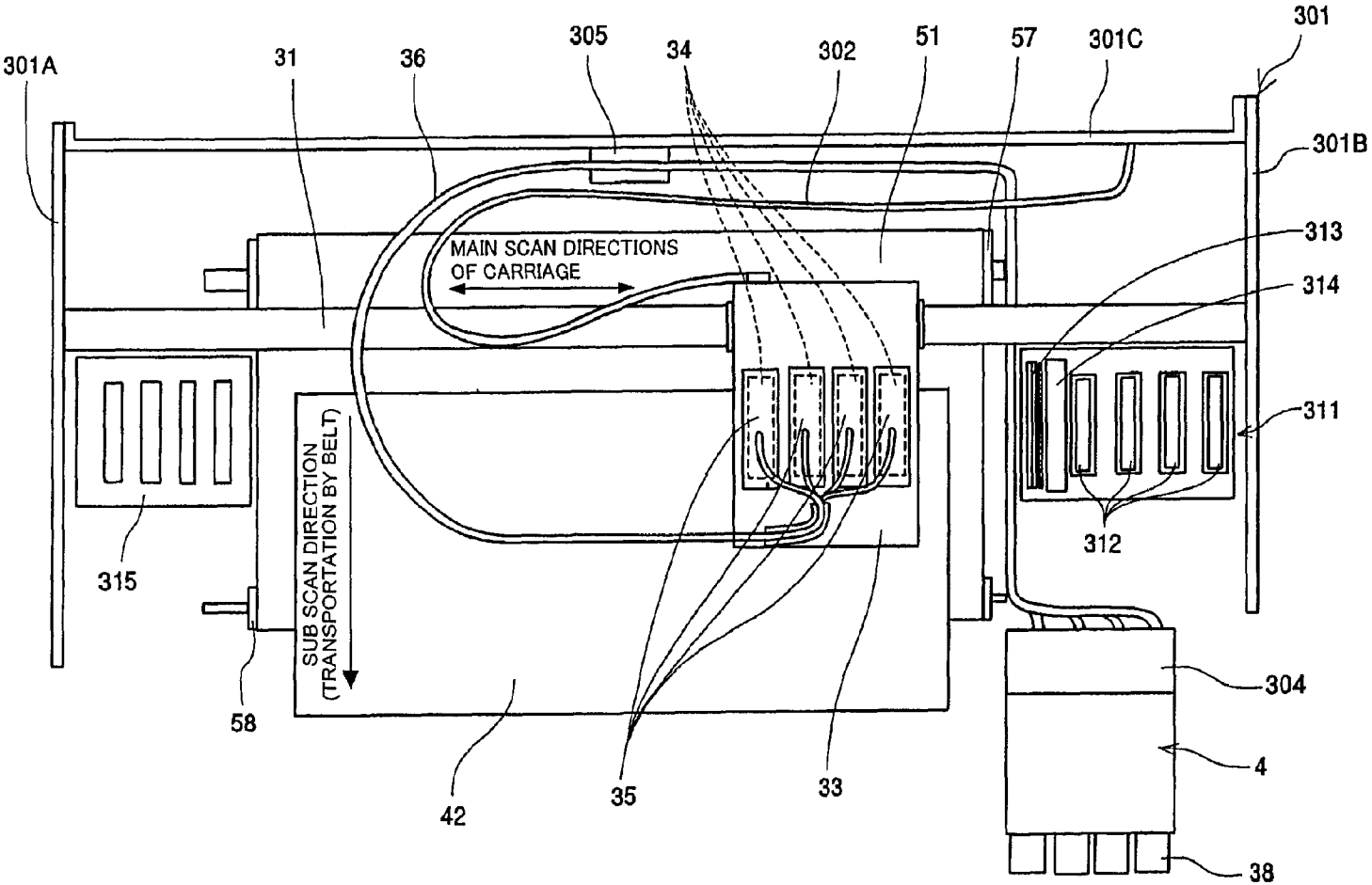
FIG. 10B is a top view showing the mechanism of the ink jet recording apparatus.
Figure 10C:
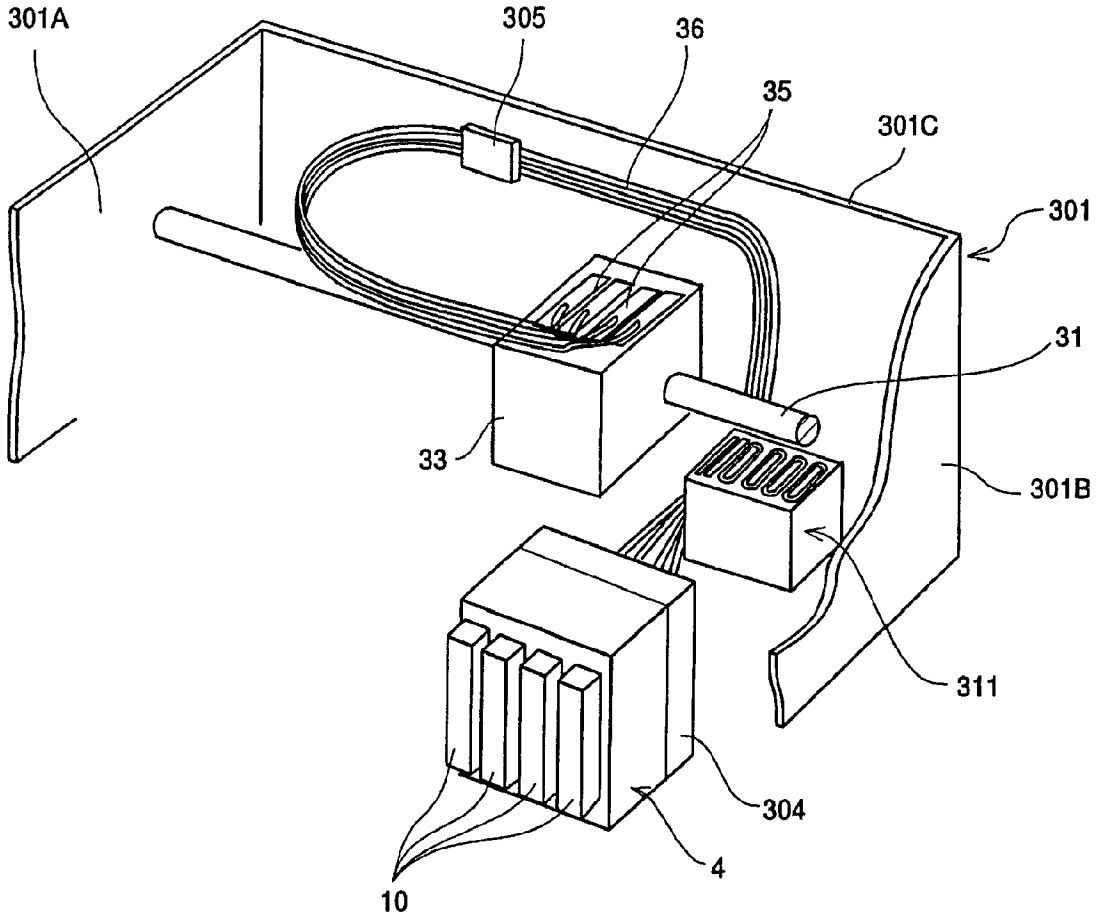
FIG. 10C is a perspective view showing some elements of the mechanism of the ink jet recording apparatus.

Referring to FIGS. 10A, 10B, and 10C, the mechanism of the ink jet recording apparatus is described below. FIG. 10A is a schematic diagram showing the entire structure of the mechanism. FIG. 10B is a top view showing the mechanism. FIG. 10C is a perspective view showing the ink supply system of the mechanism.

A frame 301 includes side plates 301A and 301B on the left and right, respectively. A carriage 33 is held with a guide rod 31 and a stay 32 fixed between the side plates 301A and 301B. The carriage is driven by a main scan motor (not shown) and is movable in the directions indicated by an arrow shown in FIG. 10B so as to scan in the main scan directions.

The carriage 33 includes recording heads 34 that are ink jet heads for discharging yellow (Y), cyan (C), magenta (M), and black (Bk) inks, respectively. Each recording head 34 is provided with multiple openings for discharging ink downward.

An ink jet head of the recording head 34 may include an energy generating unit such as the following: a piezoelectric actuator such as a piezoelectric component, a thermal actuator that uses phase change caused by membrane boiling of liquid using electro-thermal elements such as exothermic resistance, a shape memory alloy actuator using metal phase change caused by temperature change, and an electrostatic actuator using electrostatic force.

A driver IC is mounted on the recording head 34. The driver IC is connected to a control unit (not shown) via a harness (a flexible print cable) 302.

Sub-tanks 35 corresponding to respective colors are mounted on the recording head 34, and supply ink of respective colors to the recording heads 34. Ink is supplied from the ink cartridges 38 (main tanks) to the respective sub-tanks 35 via respective ink supply tubes 36. Each ink cartridge 38 contains ink of either yellow (Y), cyan (C), magenta (M), or black (Bk).

The ink cartridges are loaded in the cartridge loading unit 4 as shown in FIG. 10B. The cartridge loading unit 4 is equipped with a supply pump unit 304 for transporting the ink in the ink cartridges 38. The ink supply tubes 36 are fixed with a fixing member 305 to a rear plate 301C included in the frame 301 on the way to the sub-tanks 35.

Paper 42 is stacked on a paper stack unit (pressure plate) 41 of the paper feed tray 2. A sheet of paper 42 is transported from the paper stack unit 41 using a half-moon roller (paper feed roller) 43 and a separation pad 44 made of a high-friction material opposite the paper feed roller 43. The separation pad 44 presses against the paper feed roller 43. The paper feed roller 43 and separation pad 44 form a paper feed unit.

As a transport unit that transports the paper 42 fed by the paper feed unit under the recording head 34, the mechanism also includes the following: a transport belt 51 that holds and transports the paper 42, a counter roller 52 that pinches the paper 42 fed by the paper feed unit via a guide 45 with the transport belt 51, a transport guide 53 that guides the paper 42 for changing its transport direction by about 90 degrees, and a point press roller 55 that is pressed by a press member 54 toward the transport belt 51. The mechanism also includes a charge roller 56 that is a charging unit for charging the surface of the transfer belt 51.

The transport belt 51 is a endless belt operated by a transport roller 57 and a tension roller 58. The transport belt 51 moves in a belt transport direction (the sub scan direction) shown in FIG. 10B. The transport belt 51 includes a front layer that is a paper holding face made of 40 μm thick resin material such as ETFE pure material, of which resistance is not controlled, and a back layer (medium resistance layer, earth layer) made of the same material, of which resistance is controlled using carbon.

The charge roller 56 touches the front layer of the transport belt 51 and rotates following the movement of the transport belt 51. A tensioning force of 2.5 N is applied axially to both ends of the shaft on which the transport roller 57 rotates so as to tension the transport belt 51. The transport roller 57 also functions as the above earth layer, and touches the medium resistance layer (back layer) of the transport belt 51, and is grounded.

A guide member 61 is provided at the back of the transport belt 51 corresponding to the printable region of the recording head 34. The top face of the guide member 61 protrudes above the tangent line of two rollers (the transport roller 57 and the tension roller 58) sustaining the transport belt 51 toward the recording head 34. According to this arrangement, the transport belt 51 is displaced toward the recording head by the top face of the guide member 61 in the printable region for improving the flatness of the transport belt 51.

Multiple grooves are formed on a face of the guide member 61 touching the back face of the transport belt 51, the direction of the grooves being perpendicular to the transport direction. The grooves reduce the contact area between the transport belt 51 and the guide member 61 so that the transport belt 51 can smoothly move along the surface of the guide member 61.

Tiltable guide rollers 63 and 64 are provided at the upstream side and the downstream side, respectively, of the guide member 61, the guide rollers 63 and 64 touching the back face of the transport belt 51. The guide rollers 63 and 64 are preferably disposed to extend to near both edges of the guide member 61.

A paper discharge unit for discharging the paper 42 includes a separation nail 71 for separating the paper from the transport belt 51, a paper discharge roller 72, and paper discharge roller 73. The paper discharge tray 3 is provided below the paper discharge roller 72. The paper discharge unit is higher than the paper discharge tray 3 to some extent so that many sheets of paper 42 can be stacked in the paper discharge tray 3.

A detachable duplex paper feed unit 81 is provided at the back portion of the apparatus body 1 (also see FIG. 3). The duplex paper feed unit 81 receives the paper 42 returned by the reverse rotation of the transport belt 51, reverses the paper 42, and outputs the paper to the transport belt 51 and the counter roller 52. A manual paper feed unit 82 is provided above the duplex paper feed unit 81.

As shown in FIG. 10B, a maintenance recovery mechanism (subsystem) 311 is provided for maintaining the performance of the nozzles of the recording head 34 and recovering from problems, if any, in a unprintable region at a side of the carriage 33. The subsystem 311 includes a cap member 312 for capping the nozzle faces of the recording heads 34, a wiper blade 313 for wiping the nozzle faces, and a blank discharge receiver 314 for receiving discharged blank ink droplets (the discharging of ink droplets that do not contribute to image forming). Likewise, another blank discharge receiver 315 is provided at the other side of the unprintable region for receiving discharged blank ink droplets.

According to the above structure of the ink jet recording apparatus, the paper 42 is fed from the paper feed tray 2 sheet by sheet to a substantially vertical direction, and is guided by the guide 45. The paper 42 is transported being pinched between the transport belt 51 and the counter roller 52. The point (leading edge) of the paper 42 is guided by the transport guide 53, pressed to the transport belt 51 by the point press roller 55, and the transport direction of the paper 42 is changed about 90 degrees.

An alternating high voltage generated by a high voltage power supply controlled by a control circuit (not shown) is applied to the charge roller 56. The charge roller forms a charge pattern on the transport belt 51 in which positively charged belt-shaped regions and negatively charged belt-shaped regions alternate. When the paper 42 is fed on the alternatingly charged transport belt 51, the paper 42 is reverse-polarized. The paper 42 and the transport belt 51 form a parallel-connected imaginary capacitor. Accordingly, the paper 42 is held by the transport belt 51 and transported in the sub scan direction as the transport belt 51 moves.

The recording head 34 is activated in response to the image signal as the carriage 33 is moved in the main scan directions. During this operation, the image signal of a scan line is recorded on the halted paper 42 by discharging ink droplets. Then, the paper 42 is carried for a predetermined distance, and the image signal of the next scan line is recorded on the paper 42. This image forming operation ends in response to receipt of a signal indicating the end of the image signal or a signal indicating the end of the paper 42. Then, the paper 42 is discharged to the paper discharge tray 3.

Figure 11A:
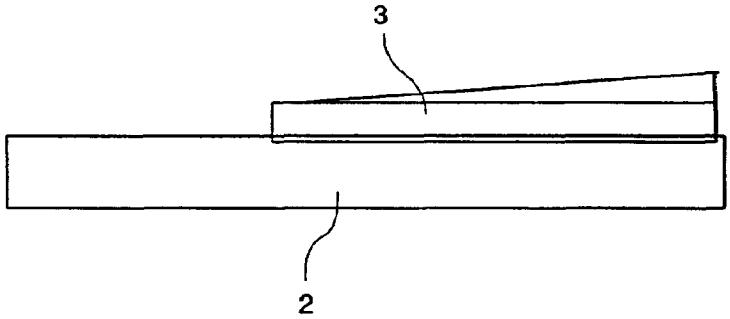
FIGS. 11A and 11B are schematic diagrams for explaining the relation between a paper discharge tray and a paper feed tray of the ink jet recording apparatus.
Figure 11B:
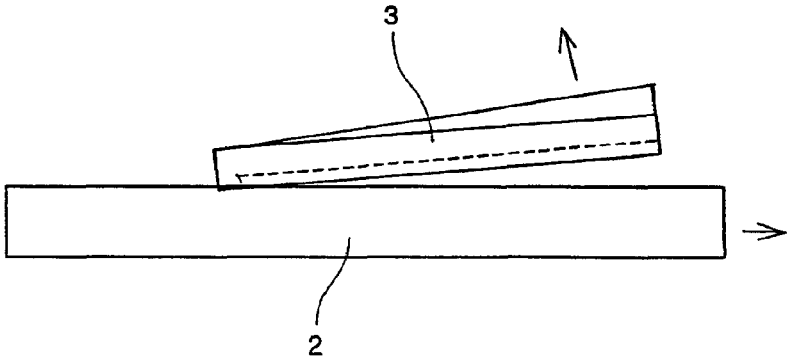
Figure 12:
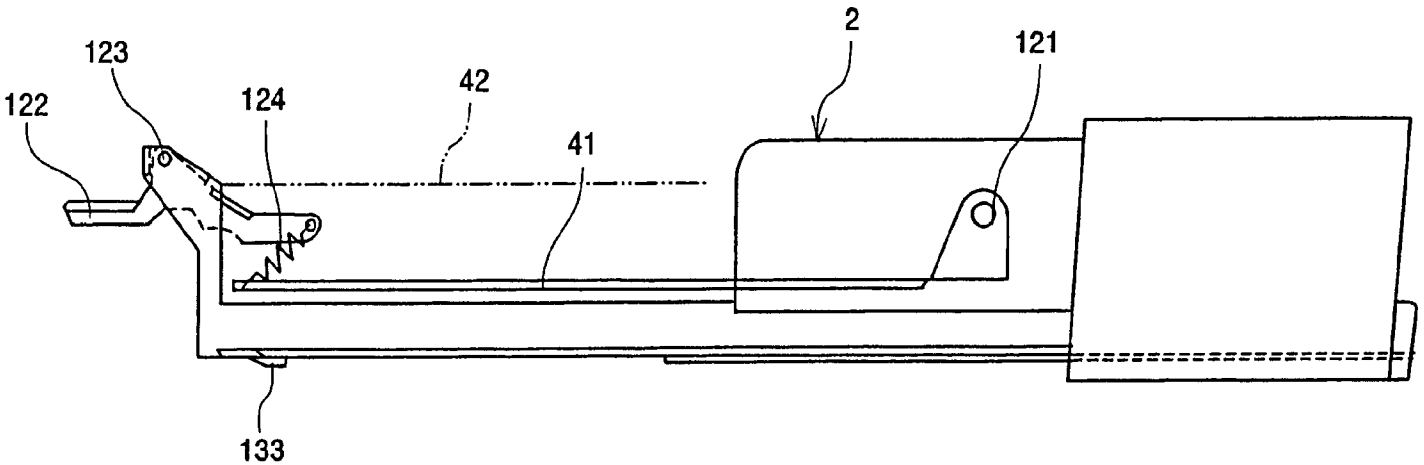
FIG. 12 is a schematic diagram for explaining a state in which the paper feed tray of the ink jet recording apparatus is drawn out of the apparatus body.

A detailed description of the paper feed tray 2 and the paper discharge tray 3 is given with reference to FIGS. 11 and 12.

A press plate 41 of the paper feed tray 2 is biased toward the paper feed roller 43 (see FIG. 10A) so that the paper 42 is pressed even in an idling state. According to this arrangement, the paper 42 can be stably fed.

The paper discharge tray 3 functions as a top cover of the paper feed tray 2. As shown in FIG. 10A, the paper discharge tray 3 can be tilted (partially rotated) around a spindle 91. A pressure release unit 92 is provided at the top of the paper discharge tray 3 that, when the paper feed tray 2 is drawn out, releases the paper feed pressure.

When the back end of the paper discharge tray 3 is lifted upward, the pressure release unit 92 of the paper discharge tray 3 presses down on the pressure plate 41 (when no paper is stacked) or the paper 42 of the paper feed tray 2, and releases the paper feed pressure.

According to the above arrangement, when the paper discharge tray 3 is simply lifted upward, the paper feed pressure applied to the paper 42 can be released. No additional operation such as the pressing of a pressure release button is required. The paper feed tray 2 is prevented from, while the paper feed pressure is applied on the paper (or on the pressure plate, if no paper is stacked) being drawn out. The paper feed tray 2 is also prevented from, while the paper feed pressure is applied on the paper, being pushed into the apparatus body and causing a paper jam.

Since the paper discharge tray 3 serves as the top cover of the paper feed tray 2, the paper discharge tray 3 can prevent dust from entering the paper feed tray 2. Additionally, it becomes possible to employ the above structure in which, when the paper discharge tray 3 is tilted, the paper feed pressure applied to the paper 42 is released.

FIG. 11A shows the state in which the paper discharge tray 3 covers the paper feed tray 2, and FIG. 11B shows the state in which the paper discharge tray 3 is lifted up. When the paper discharge tray 3 is lifted up, the paper feed tray 2 is pushed back (to the direction of the front of the recording apparatus) for a certain distance (about 20 mm, for example) as a result of the operation of a bias unit.

As described above, when the user replenishes the paper feed tray 2 with paper, the user needs only to lift the paper discharge tray 3 serving as the top cover of the paper feed tray 2. The lifting of the paper discharge tray 3 automatically releases the paper feed pressure applied to the paper and causes the paper feed tray 2 to be pushed toward the user. The user can easily make sure that the paper feed pressure applied to the paper is released and draw out the paper feed tray 2.

Figure 13:
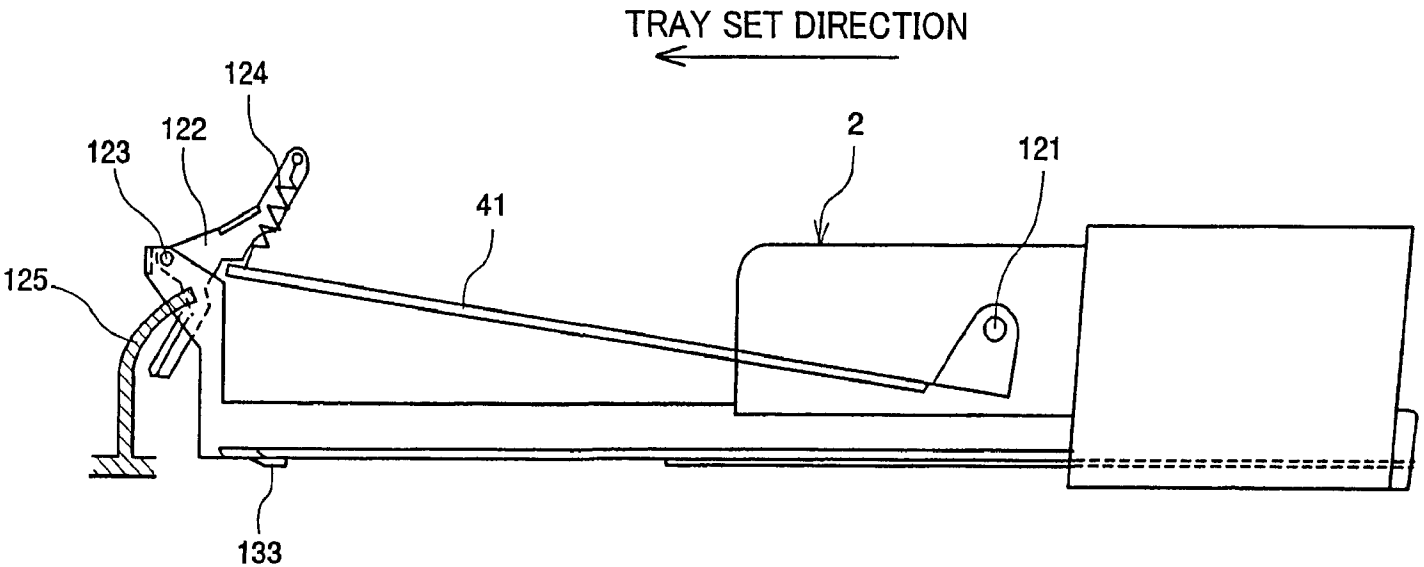
FIG. 13 is a schematic diagram for explaining a state in which the paper feed tray of the ink jet recording apparatus is pushed into the apparatus body.

Referring to FIGS. 12 and 13, a description is given about the states before and after the setting of the paper feed tray 2.

As shown in FIG. 12, the paper feed tray 2 includes a cassette bottom plate 41 that can be tilted around a spindle 121. An arm member 122 that can be tilted around a spindle 123 is provided at the point (end) of the paper feed tray 2. One of the ends of the arm member 122 and the bottom plate 41 are connected by a separation spring 124. Paper 42 can be set on the bottom plate 41 in the state shown in FIG. 12.

As shown in FIG. 13, when the paper feed tray 2 is pushed into the apparatus body, a guide member 125 causes the end of the aim member 122 provided at the point of the paper feed tray 2 to rotate. Since the bottom plate 41 and the arm member 122 are connected by the separation spring 124, the bottom plate 41 rises and tilts as the arm member 122 rotates. As a result, a preferable pressure for separating each sheet of the paper 42 is applied to the paper 42 set on the bottom plate 41.

When the paper feed tray 2 is set in the apparatus body 1, the point of the paper feed tray 2 touches the paper feed roller 43 (see FIG. 10A). The separation spring 124 applies a clockwise force (see FIG. 13) to the arm member 122. Accordingly, the paper feed tray 2 is provided with a force from guide member 125 to push it out of the apparatus body 1. When the paper feed tray 2 is released (described below), the force pushes the paper feed tray out of the apparatus body 1 (toward the user) for a predetermined distance.

Figure 14:
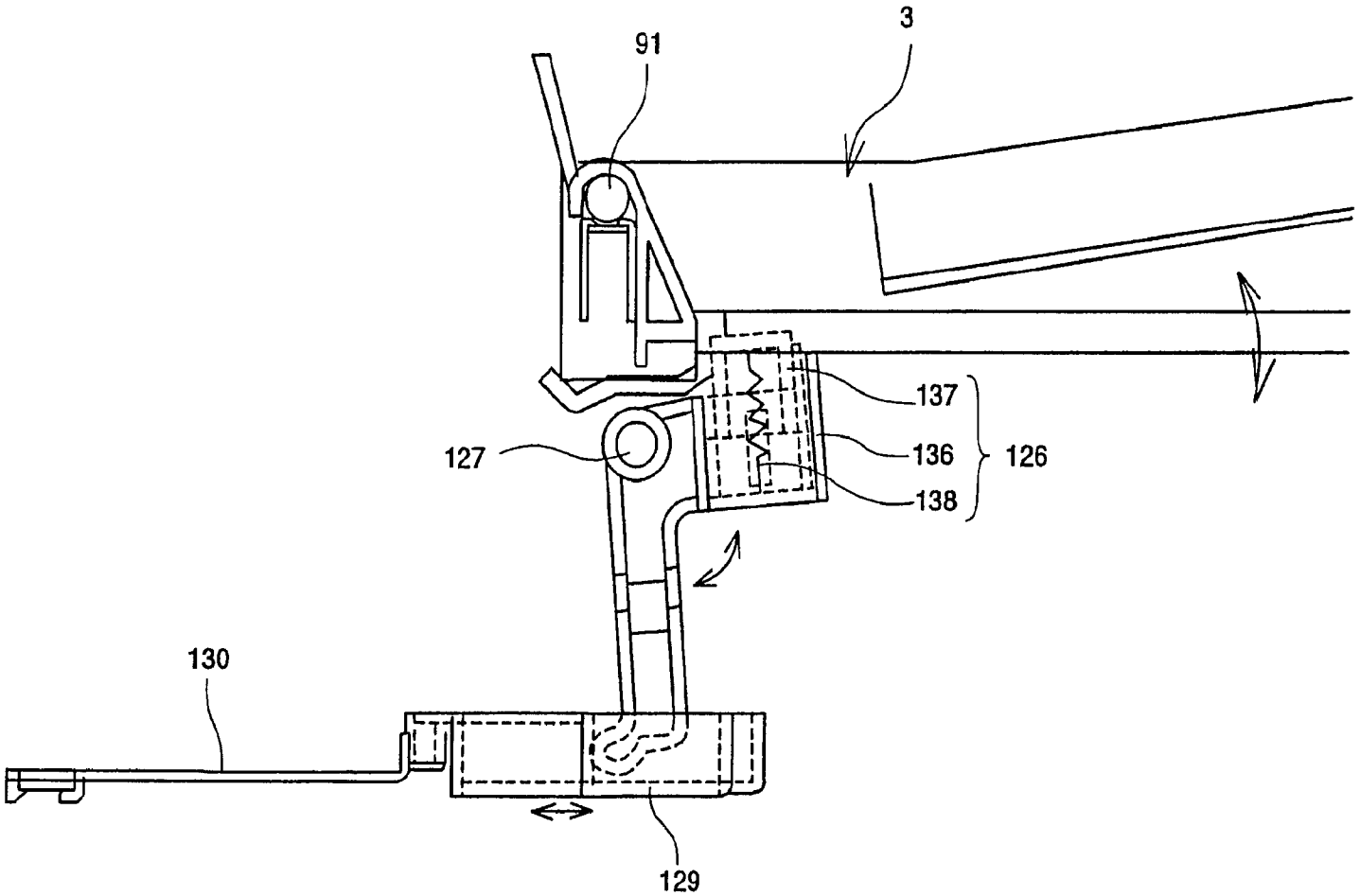
FIG. 14 is a side view for explaining a mechanism for releasing the paper feed tray of the ink jet recording apparatus.
Figure 15:
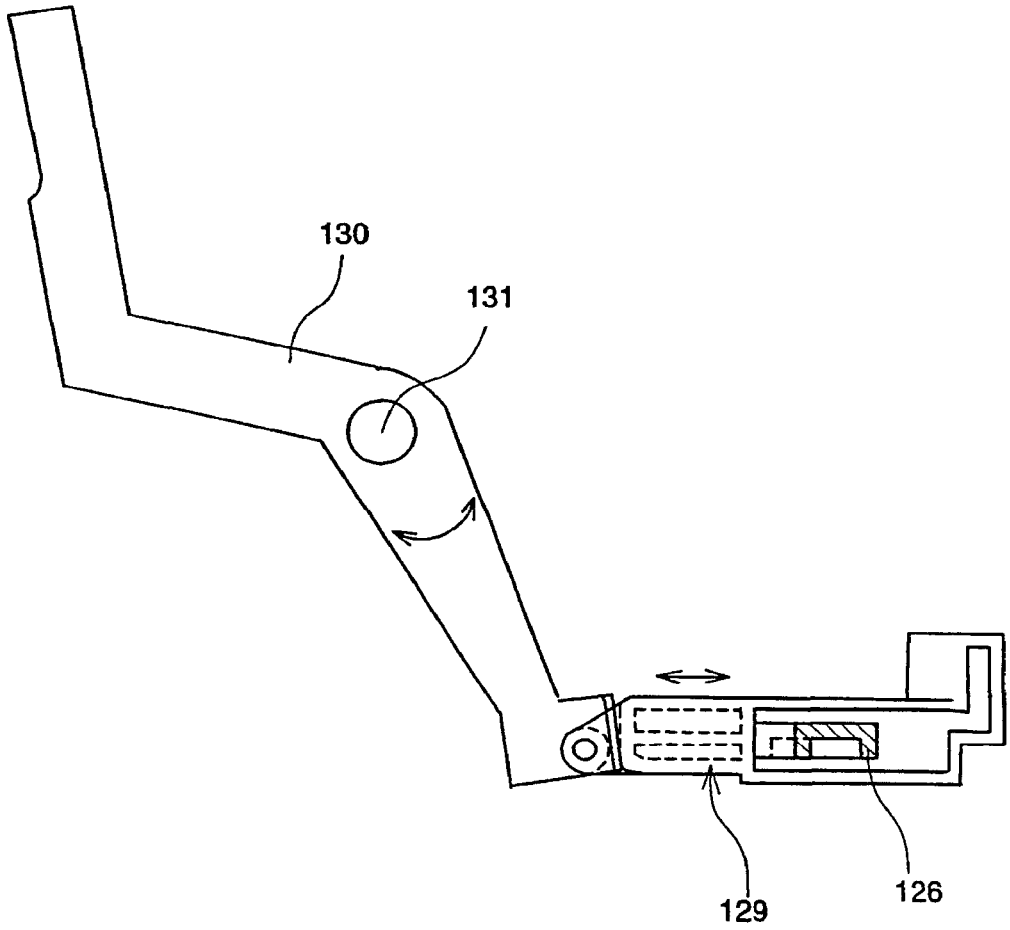
FIG. 15 is a top view for explaining the mechanism for releasing the paper feed tray of the ink jet recording apparatus.
Figure 16:
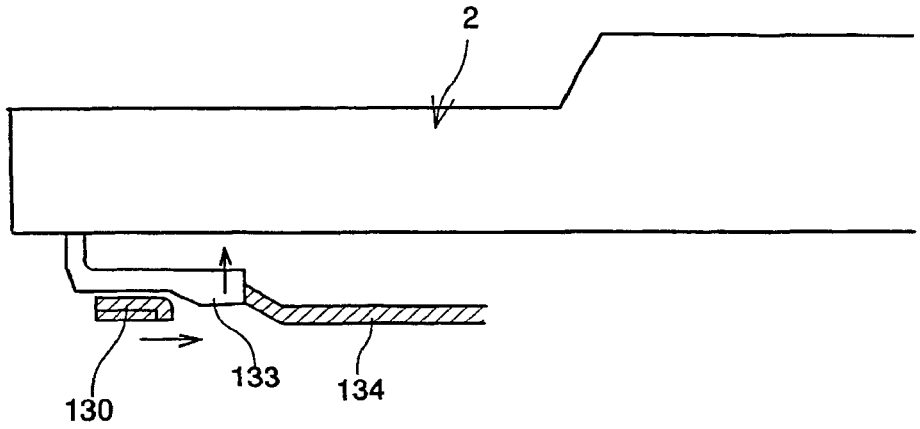
FIG. 16 is a schematic diagram for explaining the engagement between the paper feed tray and the apparatus body.

A detailed description of the paper feed tray release mechanism is given with reference to FIGS. 14 through 16.

As described above, the paper discharge tray 3 is supported by and can be tilted around the spindle 91. When the paper supply is replenished, the paper discharge tray 3 is lifted up. When the paper discharge tray 3 is lifted up, a rotatable lever 126 provided near the spindle 91 (the center of rotation of the paper discharge tray 3) is pressed and rotates around the spindle 127.

According to the rotation of the lever 126, the lever 126 pushes the lever 129 disposed below the lever 126. The lever 129 is disposed on the frame of the apparatus 1 and can move to the right and left. As shown in FIG. 15, an aim member 130 is connected to the lever 129 and rotates as the lever 129 moves. The arm member 130 can rotate around a spindle 131.

On the other hand, the paper feed tray 2 is fixed to the apparatus body 1 with the nail unit 133 provided on the bottom face of the paper feed tray 2, wherein the nail unit 133 is hooked to the frame 134 of the apparatus body 1. The nail unit 133 is flexible. As the arm member 130 rotates in the direction shown in FIG. 16, the nail unit 133 of the paper feed tray 2 is lifted up as indicated by a vertical arrow, and the hooking between the nail unit 133 and the apparatus body frame 134 is released. Because the paper feed tray 2 is pushed with the force described above, the paper feed tray 2 is automatically pushed out of the apparatus body 1 to the user.

The lever 126 includes a lever body 136, a lever assistance part 137, and a spring 138 as shown in FIG. 14. The lever assistance part 137 is connected to the lever body 136 via the spring 138. If the lever assistance part 137 is connected to the lever body 136 directly, since the paper feed tray 2 and the paper discharge tray 3 are interlocked by the release mechanism, when the paper feed tray 2 is set into the apparatus body, the paper discharge tray 3 needs to be lowered. The spring 138 makes it possible to set the paper feed tray 2 whichever the position of the paper discharge tray 3 is.

If the paper feed tray 2 is set and then the paper discharge tray 3 is pushed down, the lever unit of the paper discharge tray 3 pushes the lever 126. Because the lever assistance part 137 is supported by the spring 138 against the lever body 136, the lever assistance part 137 clears. The paper feed tray 2 is not affected by the pushing down of the paper discharge tray 3.

According to the above arrangements, the paper feed tray 2 is automatically pushed out of the apparatus body 1 as the paper discharge tray 3 is lifted up and pushes down.

Figure 17:
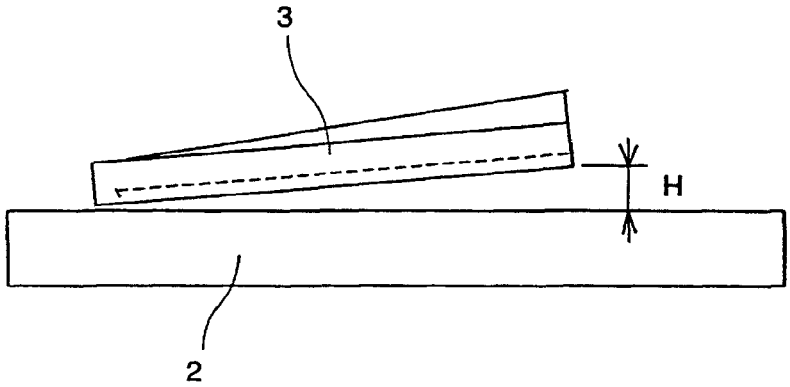
FIG. 17 is a schematic diagram for explaining the replenishing of the paper feed tray with paper.

The image forming apparatus according to the embodiment is designed so that the paper feed tray 2 cannot be completely pulled out of the apparatus body 1. As shown in FIG. 17, the pushed-out paper feed tray 2 and the lifted paper discharge tray 3 form an opening. The height H of the opening is constrained. That is, the height to which the paper discharge tray 3 can be lifted and the distance to which the paper feed tray 2 can be drawn out constrain the size of the opening. Accordingly, the user is prevented from resupplying too much paper to the paper feed tray 2.

Figure 18:
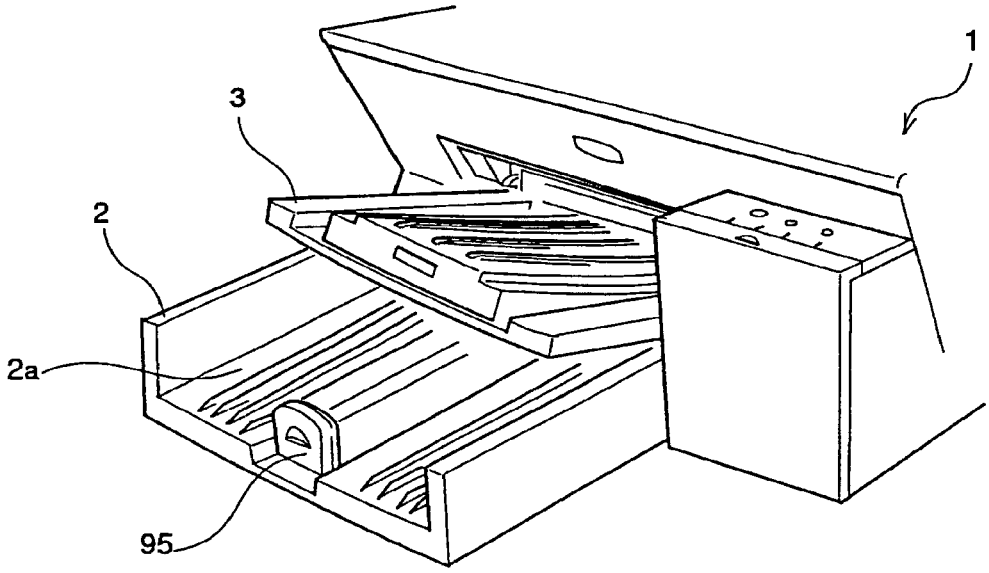
FIG. 18 is a perspective view for explaining the replenishing of the paper feed tray with paper.

As shown in FIG. 18, the opening 2*a* of the paper feed tray 2 is blocked by an end fence 95. The end fence 95 makes it difficult to insert paper through the Opening 2*a*. The user is prevented from replenishing the paper supply erroneously.

Figure 19:
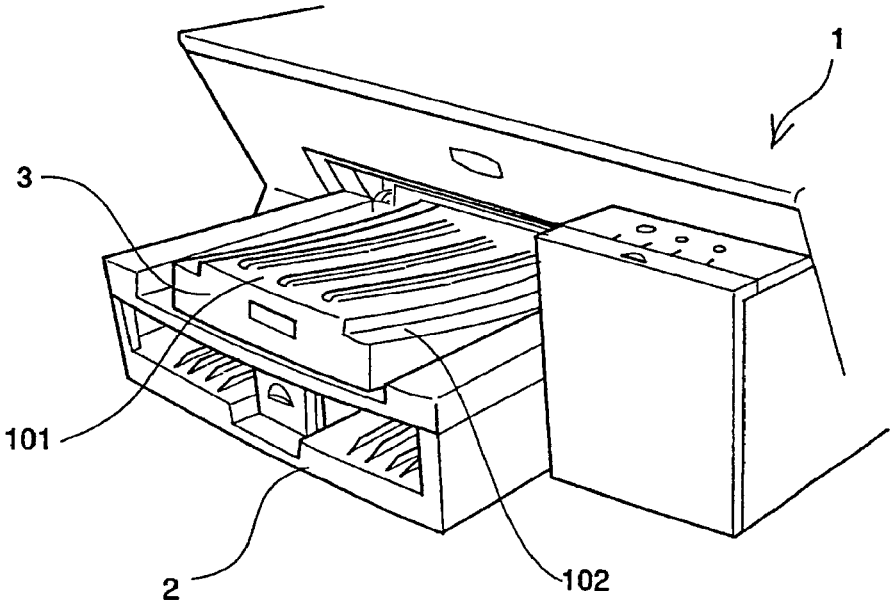
FIG. 19 is a perspective view for explaining the paper discharge tray of the ink jet recording apparatus.
Figure 20:
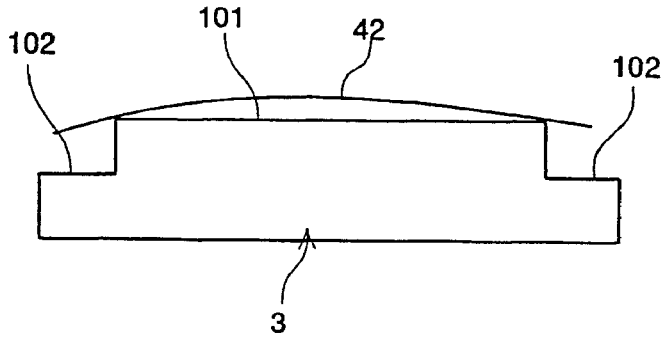
FIG. 20 is a schematic diagram for explaining the paper discharge tray.

A description of the paper discharge tray 3 is given with reference to FIGS. 19 and 20. FIG. 19 is a perspective view showing the recording apparatus 1. FIG. 20 is a front view of the paper discharge tray 3.

The paper discharge tray 3 includes a slope unit 101 of which the downstream side in the direction in which paper is discharged is higher than the upstream side. A down step 102 is provided to each edge of the slope unit (center unit) 101 in a directions perpendicular to the direction in which the paper is discharged.

Since the upstream side in the direction in which the paper is discharged is lower than the downstream side, the height between the paper discharge roller 72 and the paper discharge tray 3 becomes great. According to this arrangement, many sheets of paper can be stacked on the paper discharge tray 3. Additionally, because the point (leading edge) of the paper 42 touches the paper discharge tray 3 quickly, the stacked paper 42 is prevented from rolling up.

In the case in which the transport roller 57 has a short radius and the direction in which paper is transported is changed about 90 degree for making the image forming apparatus compact, and in the case in which images are recorded by the ink jet recording method, the paper 42 is subject to roll up. The paper being discharged can be prevented from coming in contact with the paper already discharged into the discharge tray 3 by preventing the already discharged paper from rolling up. Then, the discharging of the paper becomes smooth.

Because the down step unit 102 is formed at each edge of the center unit 101 in the direction perpendicular to the direction in which the paper is discharged, even if the paper 42 has rolled up, the rolling up on both sides of the paper 42 can be cleared as shown in FIG. 20. The discharging of the paper becomes smooth.

Figure 21:
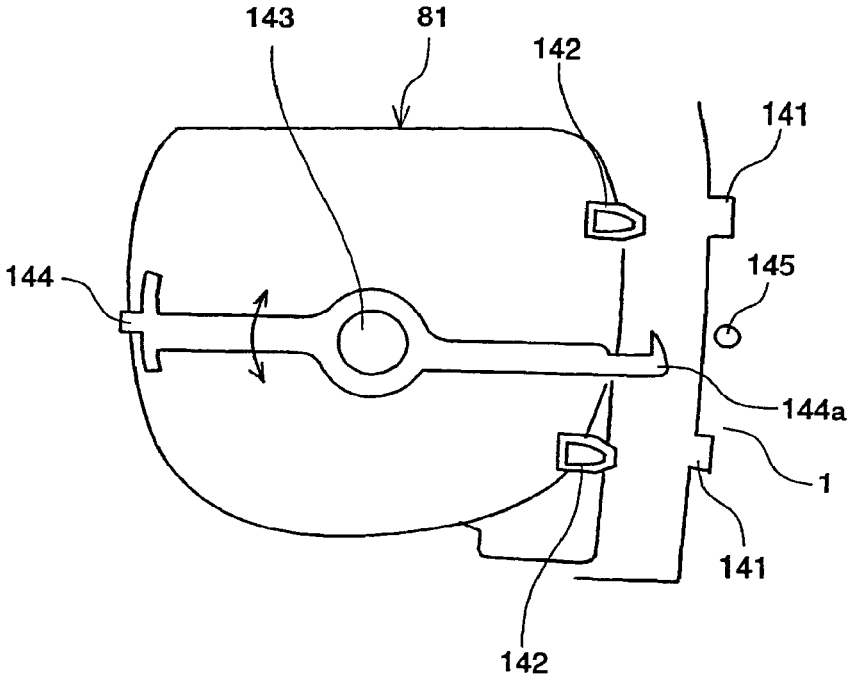
FIG. 21 is a schematic diagram for explaining a duplex paper feed unit before being loaded to the apparatus body.
Figure 22:
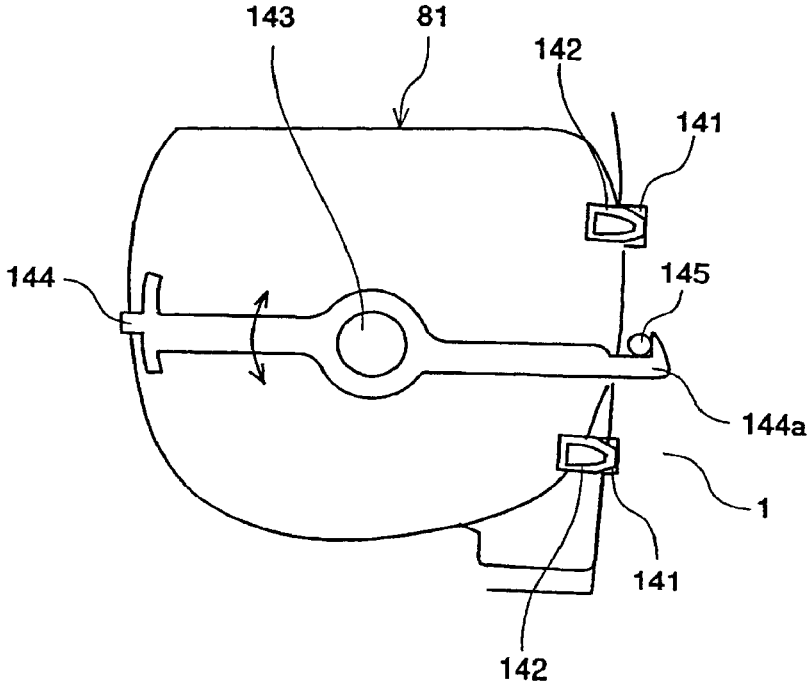
FIG. 22 is a schematic diagram for explaining the duplex paper feed unit after being loaded to the apparatus body.

A description is given of a transport cover attached to the apparatus body 1 in the place of the duplex paper feed unit 81. Referring to FIGS. 21 and 22, a description is provided of the mechanism by which the duplex paper feed unit 81 is attached. FIG. 21 is a schematic diagram showing the state before the duplex paper feed unit 81 is attached, and FIG. 22 is a schematic diagram showing the state after the duplex paper feed unit 81 has been attached.

Notches 141 (upper and lower) for positioning the duplex paper feed unit are formed on the apparatus body 1. Boss units 142 corresponding to the respective notches are formed on the duplex paper feed unit 81. Accordingly, when the duplex paper feed unit 81 is attached to the apparatus body 1, the duplex paper feed unit 81 is positioned by fitting the boss units 142 into the notches 141.

A lever 144 rotatable around a spindle 143 is provided on the duplex paper feed unit 81. The point 144*a* (lock unit) of the lever 144 can be locked to a fixing pin 145 on the apparatus body side. After the duplex paper feed unit 81 is positioned on the apparatus body 1, the lever 144 is rotated. The duplex paper feed unit 81 can be fixed on the apparatus body 1 by hooking the point unit 144*a* of the lever 144 to the fixing pin 145 provided on the apparatus body 1.

Figure 23:
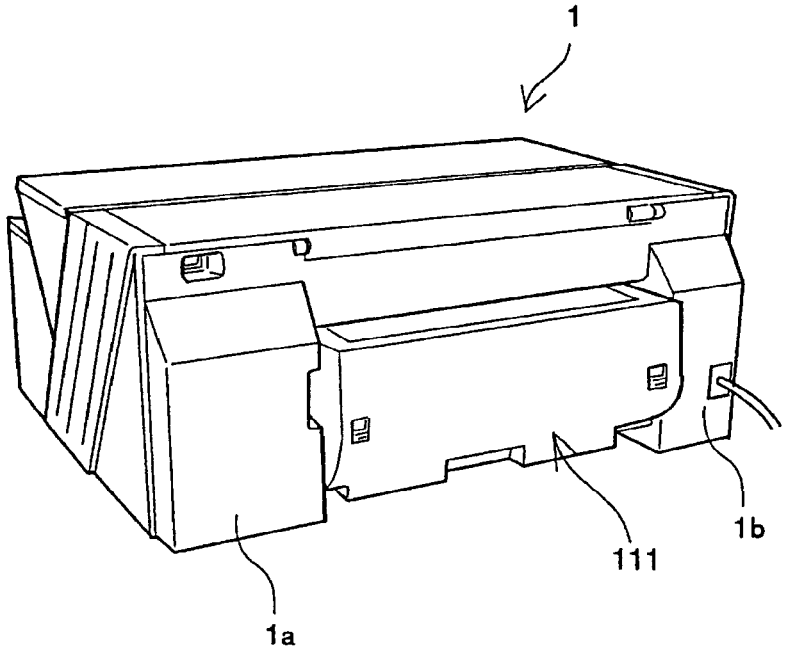
FIG. 23 is a rear perspective view of the ink jet recording apparatus for explaining a transport cover.
Figure 24:
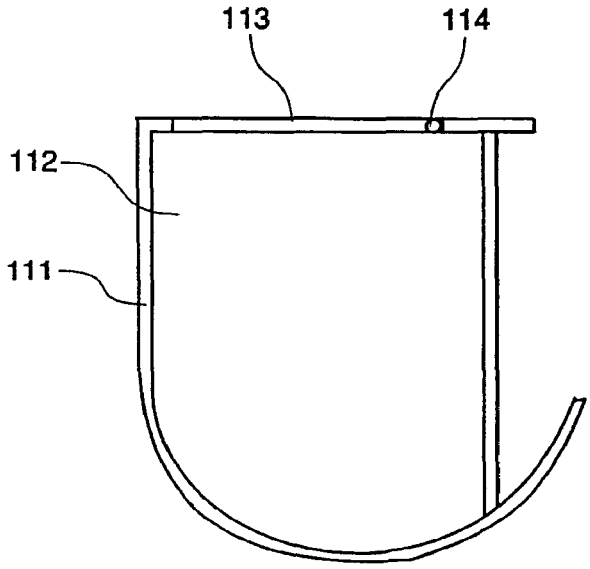
FIG. 24 is a cross-sectional view showing the transport cover.

Referring to FIGS. 23 and 24, the transport cover 111 is described below. FIG. 23 is a perspective view showing the rear face of the recording apparatus, and FIG. 24 is a cross-sectional view showing the transport cover 111. When the duplex paper feed unit 81 is not used, the interior of the transport mechanism is exposed. Accordingly, the transport cover 111 having substantially the same outline as the duplex paper feed unit 81 can be attached to the apparatus body 1.

In this case, the shape of the outside face of the transport cover 111 is about the same as that of the protruding units 1*a* and 1*b* protruding one from each side of the rear face of the apparatus body 1. According to the shape of the transport cover 111, the right and left sides of the rear face do not protrude alone, which prevents the apparatus body 1 from looking bigger than it actually is.

The inside of the transport cover 111 is a storage unit 112. A cover member 113 that can be opened by rotating around a hinge 114 is provided on the top face thereof. Accessories and supplies such as a user's manual, an installation disk, and preparatory ink may be stored in the storage unit 112. According to the above arrangement, the image forming apparatus with a storage unit 112 of good appearance can be provided.

According to the present embodiment, the transport cover 111 serves as a Side wall of the storage unit 112. According to another embodiment, a storage pocket may be provided as a separate part of the transport cover 111. The storage pocket may be fixed to the transport cover 111 or may be formed monolithic with the transport cover 111.

A description is given next of an ink jet recording apparatus in which front-side operations are realized.

As described above, the paper 42 can be fed from the front side and is discharged to the front side of the recording apparatus. Additionally, as shown in FIG. 2B, the ink cartridge 38 can be loaded from the front side and unloaded to the front side.

In order to realize the front-side operations as described above, it is necessary to provide the sub-tanks 35 on the carriage 33 for supplying ink to the recording heads 34, and to supply the ink from the ink cartridges 38 to the sub-tanks 35. The ink cartridges 38 need to be thin.

Figure 25:
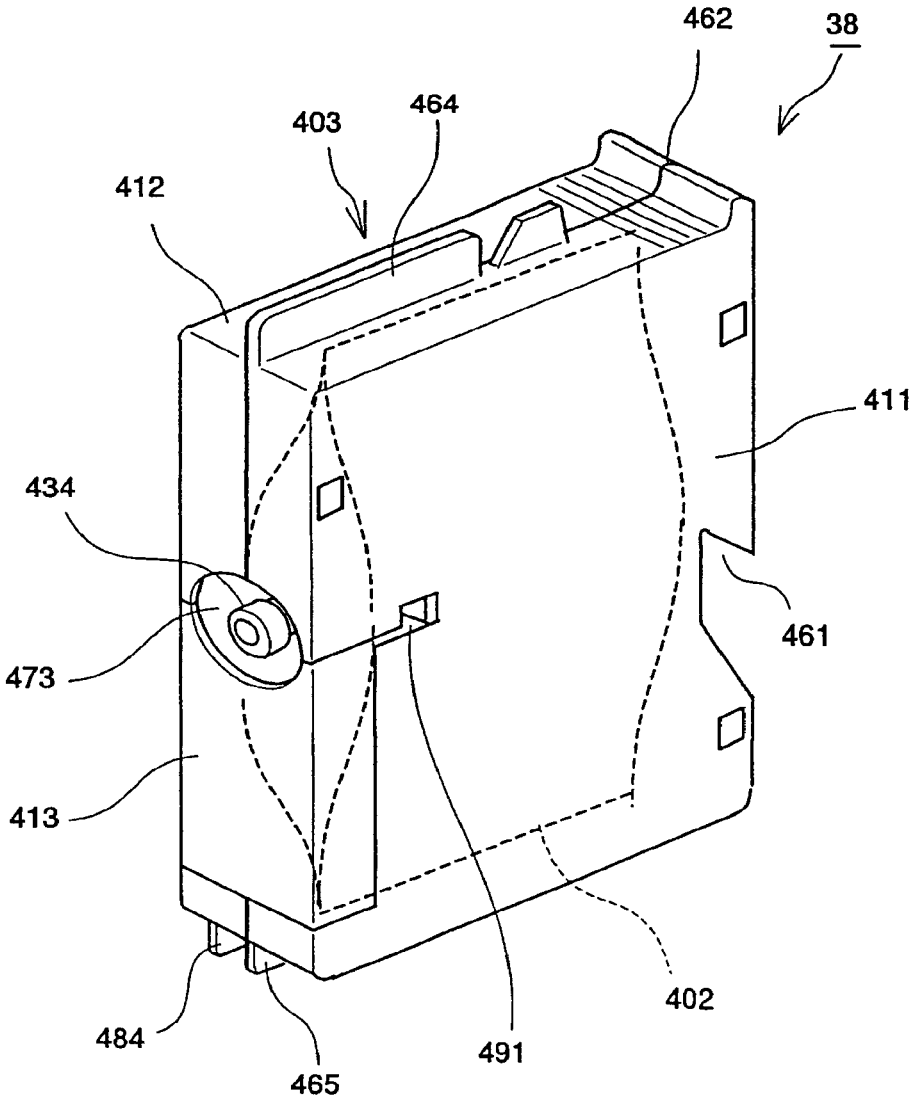
FIG. 25 is a perspective view of an ink cartridge according to an embodiment.
Figure 26:
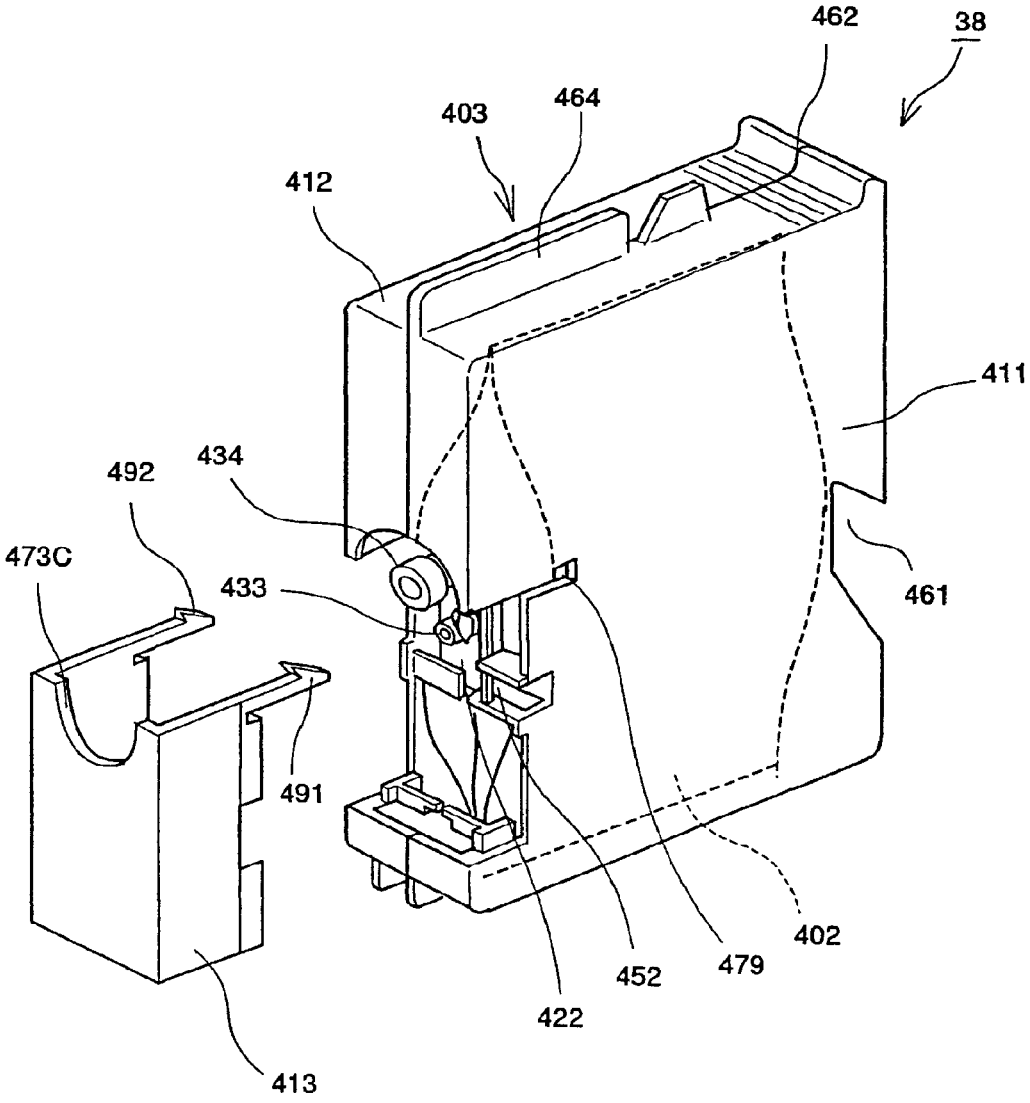
FIG. 26 is a perspective view of the ink cartridge with its third housing disassembled.
Figure 27:
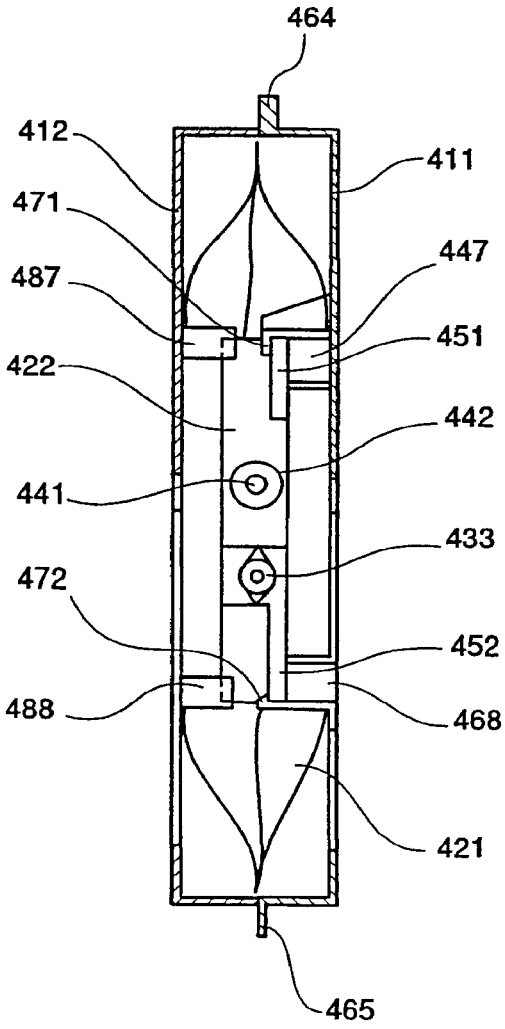
FIG. 27 is a front cross-sectional view showing the ink cartridge.

Referring to FIGS. 25 through 27, a description of the ink cartridge 38 according to the present embodiment is given below.

The ink cartridge 38 includes an ink bag 402 for containing ink and a housing 403 for storing the ink bag 402. The housing 403 includes a first housing 411, a second housing 412, and a third housing 413. The first housing 411 and the second housing 412 form a protection cover for protecting the side faces of the ink bag 402. The housing 403 is divided into the first housing 411 and the second housing 412 that cover the ink bag 402 with planes parallel to the direction in which ink is supplied.

Figure 28:
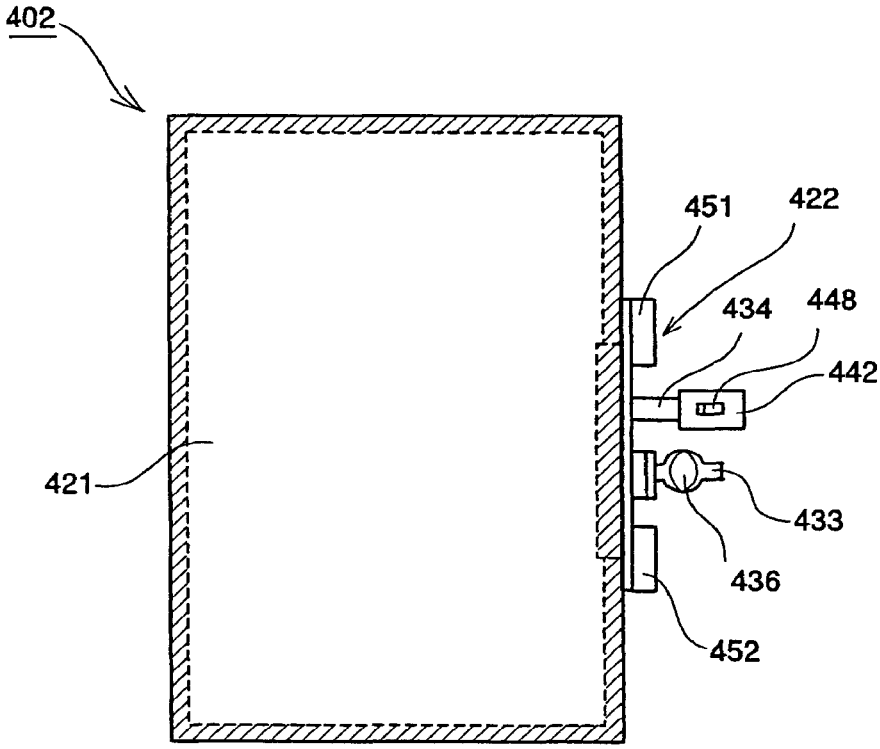
FIG. 28 is a side view of an ink bag according to an embodiment.
Figure 29:
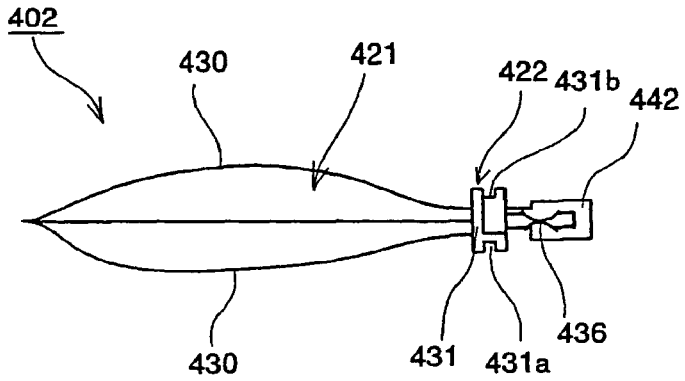
FIG. 29 is a bottom view of the ink bag shown in FIG. 28 that is filled with ink.
Figure 30:
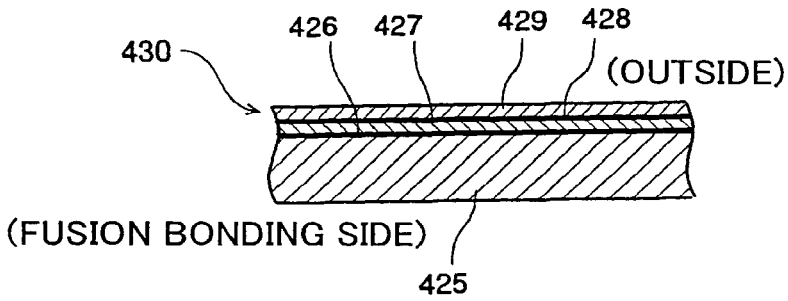
FIG. 30 is a schematic diagram showing the cross-section of aluminum laminated film that forms the bag body of the ink bag.
Figure 31:
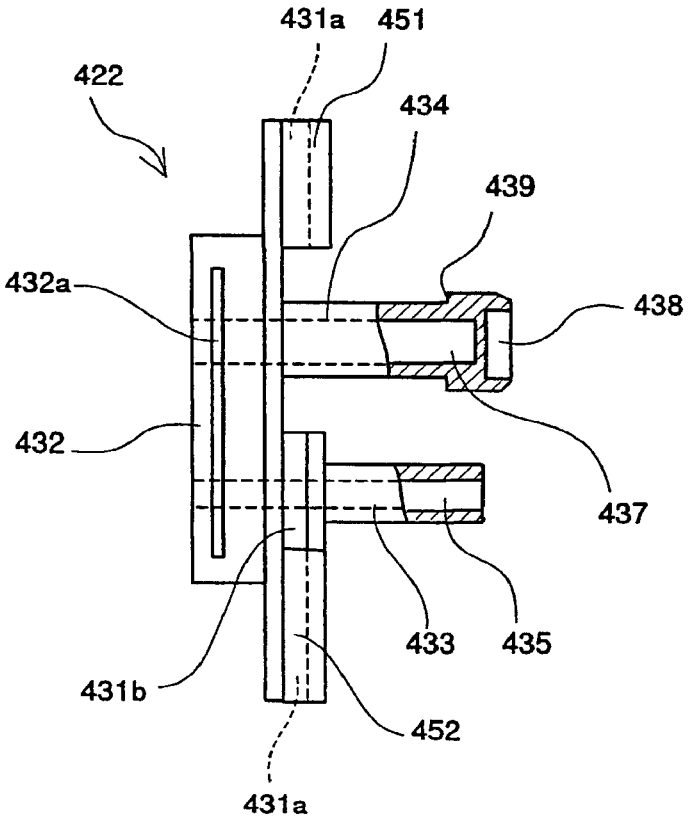
FIG. 31 is a side view of a holding member of the ink bag.
Figure 32:
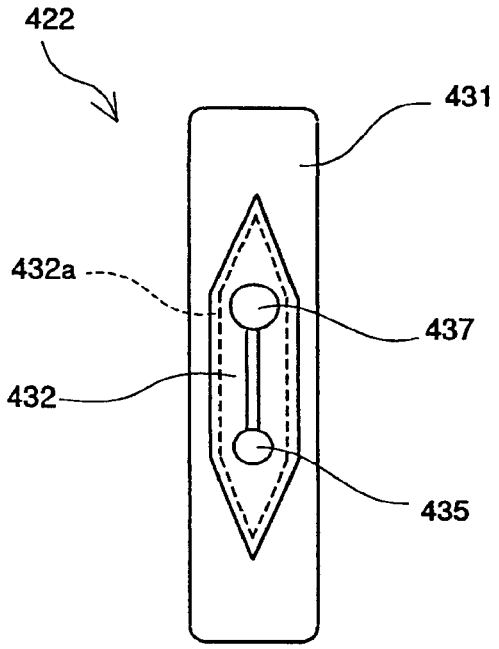
FIG. 32 is a rear view of the holding member shown in FIG. 31.
Figure 33:
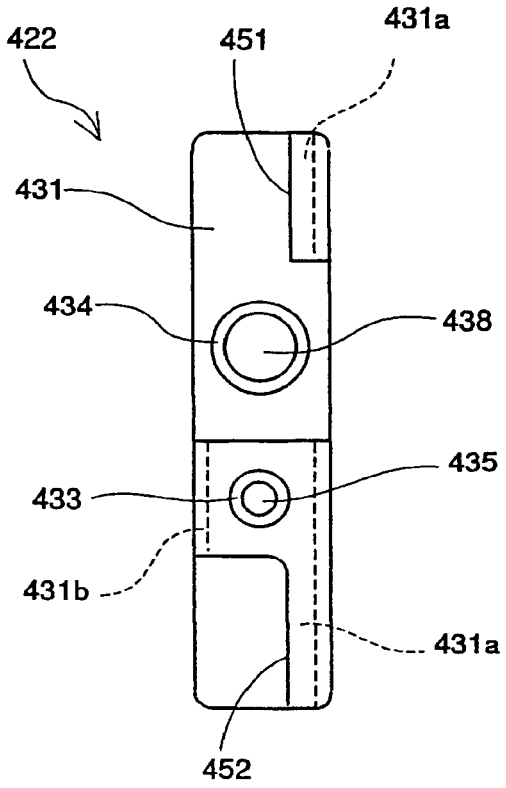
FIG. 33 is a front view of the holding member shown in FIG. 31.
Figure 34:
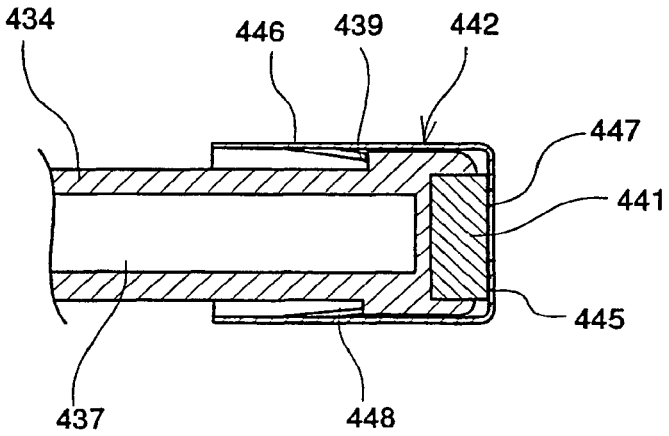
FIG. 34 is a cross-sectional view of an ink outlet of the ink bag.

Referring to FIGS. 28 through 34, the ink bag 402 according to the present embodiment is described below. FIG. 28 is a side view of the ink bag 402. FIG. 29 is a bottom view of the ink bag 402 for explaining a state in which the ink bag 402 is filled with ink. FIG. 30 is a cross-sectional view of aluminum laminated film forming the body of the ink bag 402. FIG. 31 is a side view showing a holding member 422 of the ink bag 402. FIG. 32 is a rear view of the holding member 422. FIG. 33 is a front view of the holding member 422. FIG. 34 is a cross-sectional view showing the ink outlet 434 of the ink bag 402.

The ink bag 402 includes a flexible bag body 421 made of substantially rectangular aluminum laminated film and the holding member 422 made of resin fixed on a long edge of the bag body 421.

As shown in FIG. 30, the bag body 421 according to the present embodiment is made of aluminum laminated film 430 in which a dry lamination 426, an aluminum film 427, a dry lamination 428, and PA 429 are laminated on LDPE 25 (but not limited to the aluminum laminated film 430). As shown in FIGS. 28 and 29, two sheets of the aluminum laminated film 430 are adhered to each other at their edges (the shaded area in FIG. 28 to form a bag, and the bag is further adhered to the holding member 422. Unlike a conventional bag body having a frame therein for keeping its shape, the bag body 421 according to the present embodiment does not have such a frame therein and is flexible. Accordingly, little ink remains unused.

As shown in FIGS. 31 through 33, the holding member 422 includes a flange unit 431, a connection unit 432 formed on a face of the flange unit 431, an ink inlet unit 433 (ink inlet unit before adhesion is shown) formed on the other face of the flange unit 431, and the ink outlet unit 434. The above units are formed monolithically. The bag body 421 is thermally adhered to the connection unit 432. The ink inlet unit 433 and the ink outlet unit 434 are hollow.

As shown in FIG. 32, both ends of the connection unit 432 (the ends in the direction of length of the holding member 422) are tapered like a diamond. A groove 432*a* surrounds the connection unit 432. According to the arrangement, the bag body 421 made of the aluminum laminated film 430 can be firmly adhered to the grooved perimeter of the connection unit 432.

A hole 435 piercing the flange unit 431 and the connection unit 432 is formed in the ink inlet unit 433. After the ink bag 402 is filled with ink, the ink inlet unit 433 is sealed by thermal fusion bonding. The sealed ink inlet unit 433 is shown as a sealed unit 436 in FIGS. 28 and 29. The ink inlet unit 433 can be sealed by thermal fusion bonding easily and firmly.

A hole 437 for discharging ink piercing the flange unit 431 and the connection unit 432 is formed in the ink outlet unit 434. An opening 438 for fitting a flexible member that seals the hole 437 for discharging ink at the point of the ink outlet unit 434 is provided. A step unit 439 to fit a cap member for holding the flexible unit is formed at a further peripheral region around the ink outlet unit 434.

The flexible member 441 is fitted into the point unit of the ink outlet unit 434 as shown in FIG. 34, and the flexible member 441 is sustained by a cap member 442. The flexible member 441 is preferably made of rubber material such as silicon, fluorine, or butyl. When a hollow pin-shaped supply pin (that leads ink to the recording apparatus body) is inserted from the recording apparatus body side, the flexible member 441 maintains the sealing but enables ink to be supplied to the recording apparatus body. When the supply pin is pulled out, the flexible member expands and keep the sealing intact.

The cap member 442 is formed by a pipe-shaped member 446 having a flange unit 445 for holding the flexible member 441. A hole 447 is formed on the flange unit 445 for inserting the supply pin from the recording apparatus body side. Multiple blocking blocks 448 bent inward are formed on the pipe-shaped member 446. The cap member 442 is fitted on the point of the ink outlet unit 434. The cap member 442 is kept fitted with the blocking blocks 448 engaging the step unit 439 as shown in FIG. 34.

As shown in FIG. 28, the ink outlet unit 434 of the holding member 422 is disposed substantially at the center in the height direction of the ink bag 402. Accordingly, when the ink cartridge 38 is positioned longitudinally (as shown in FIG. 1), the ink in the bag body 421 of the ink bag 402 flows smoothly compared to the case in which the ink outlet unit is disposed at a side. Thereby, the ink can be consumed completely.

Engage units 451 and 452 that engage blocking nails (described below) provided on the first housing 411 side are formed on the holding member 422 monolithically. Groove units 431*a* and 431*b* are formed at positions corresponding to the engage unit 451 and 452 on the side face of the flange unit 431.

As described above, the ink bag 402 is formed by fixing the holding member 422 on an edge of the substantially rectangular flexible bag body 421. The holding member 422 has the ink inlet unit 433 for replenishing the bag body 421 with ink and the ink outlet unit 434 for discharging the ink contained in the bag body 421. The holding member 422 further has the engage units 451 and 452. As a result, the ink can be consumed almost completely. The ink bag 402 can be stably and detachably fixed to the housing 403.

Figure 35:
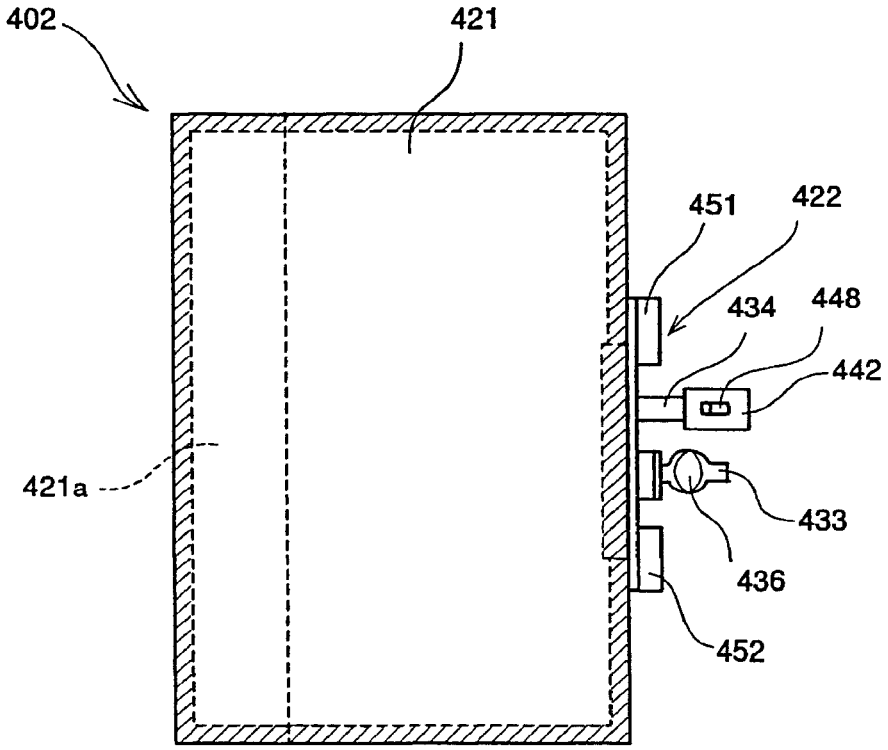
FIG. 35 is a side view of an ink bag according to another embodiment, the ink bag being stored in an ink cartridge.
Figure 36:
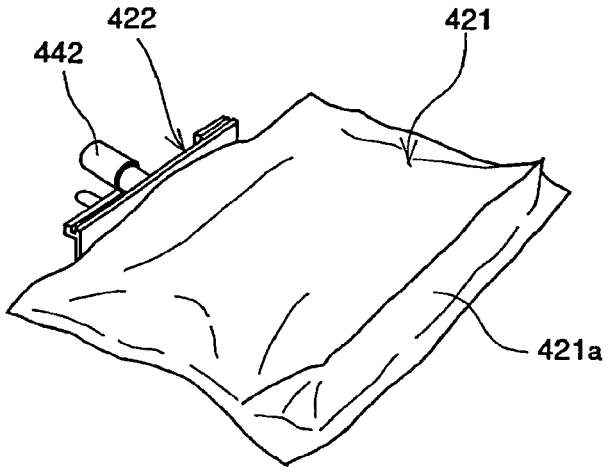
FIG. 36 is a perspective view of the ink bag that is filled with ink.
Figure 37:
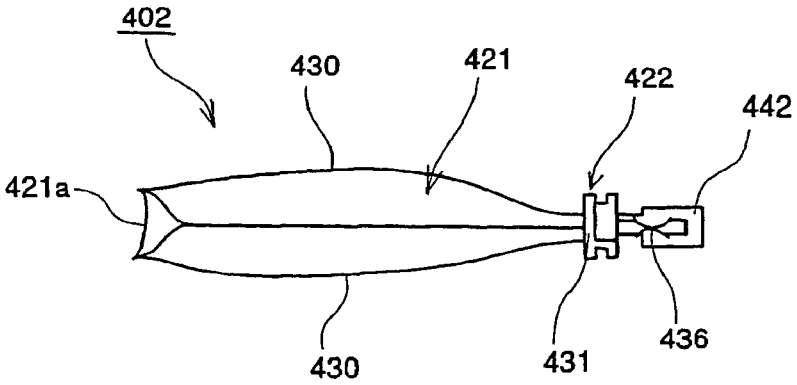
FIG. 37 is a bottom view of the ink bag shown in FIG. 35 that is filled with ink.

An ink bag 402 according to another embodiment is described below with reference to FIGS. 35 through 37. FIG. 35 is a side view of the ink bag 402, FIG. 36 is a perspective view of the ink bag 402 that is filled with ink, and FIG. 37 is a bottom view of the ink bag 402 shown in FIG. 35.

In the ink bag 402, a bag body 421 is formed by two sheets of aluminum laminated film 430 and a bottom unit 421*a* made of the same aluminum laminated film 430. According to the above arrangement, the ink bag 402 can contain a large amount of ink therein.

Figure 38:
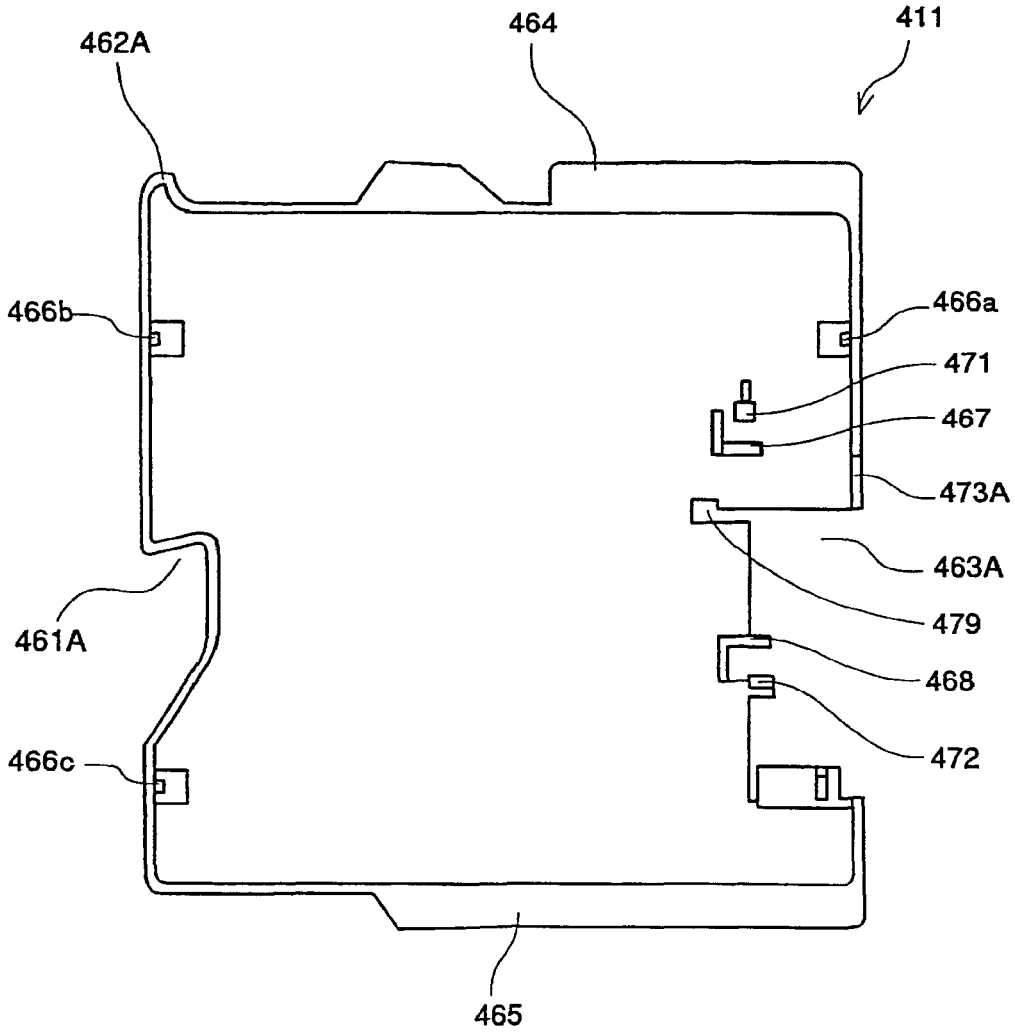
FIG. 38 is a side view of a first housing of the ink cartridge.
Figure 39:
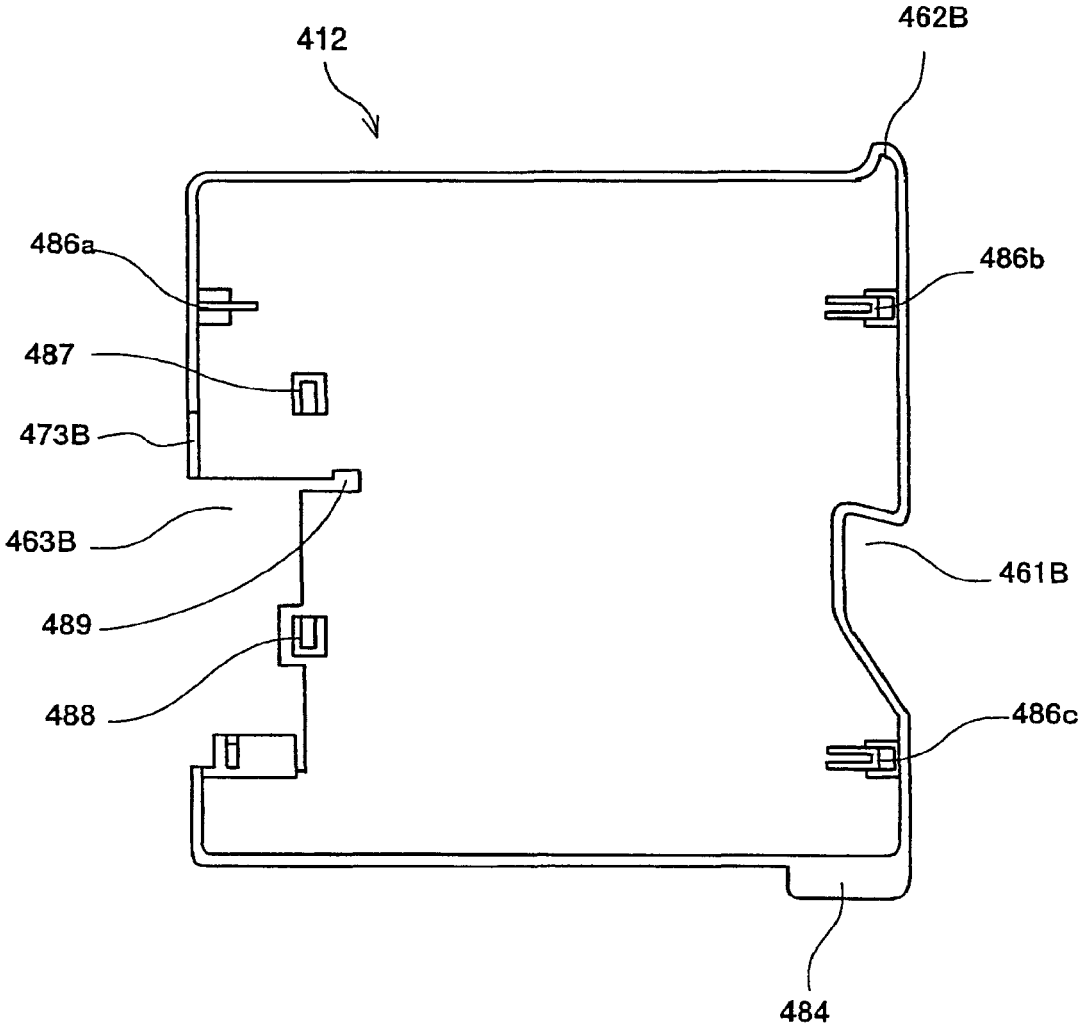
FIG. 39 is a side view of a second housing of the ink cartridge.

The structure of the housing of the ink cartridge 38 is described below with reference to FIGS. 38 and 39. FIG. 38 is a side view of a first housing 411 of the ink cartridge 38, and FIG. 39 is a side view of a second housing 412 of the ink cartridge 38.

The housing 403 of the ink cartridge 38 (see FIG. 25) includes a first housing 411, a second housing 412 similar to the first housing 411, and a third housing 413. The first housing 411 and the second housing 412 are combined thereby to form a combined housing, and the third housing 413 is fitted at a lower front portion of the combined housing thereby to form the rectangular housing 403. A recess unit 461 and a hooking unit 462 are formed on the housing 403. An opening 473 to which the ink outlet unit 434 faces is formed on the front face of the housing 403.

The first housing 411 is substantially rectangular as shown in FIG. 38, for example. On the outer circumference of the first housing 411, a recess unit 461A, a hooking unit 462A, a notch unit 463A, and guide units 464 and 465 are formed. The recess unit 461A and the hooking unit 462A are the half portions of the recess unit 461 and the hooking unit 462, respectively. The notch unit 463A forms a space into which an ink replenishing apparatus can be introduced for replenishing with ink the ink bag 402 held between the first housing 411 and the second housing 412. The guide unit 464 and 465 are used for loading the ink cartridge to the recording apparatus body or the ink replenishing apparatus.

Engage units 466*a*, 466*b*, and 466*c* to which block nails of the second housing 412 (described below) are formed at three corners of the inner wall of the first housing 411. Positioning units 467 and 468 that position the holding member 422 are built on the inner wall of the first housing 411 for holding the holding member 422 of the ink bag 402. Engage nails 471 and 472 for engaging the engage salients 451 and 452 of the holding member 422 are also built on the inner wall of the first housing 411.

An arc unit 473A corresponding to about a quarter of the opening 473 is formed on the front face of the first housing 411. An engage recess 479 to which, when the third housing 413 is fitted, an engage nail of the third housing 413 is engaged is formed on the first housing 411.

As shown in FIG. 39, for example, the second housing 412 is substantially similar to the first housing 411. On the outer circumference of the second housing 412, a recess unit 471B, a hooking unit 442B, a notch unit 463B, and an identification unit 484 are formed. The recess unit 471B and the hooking unit 442B are the half portions of the recess unit 461 and the hooking unit 462, respectively. The notch unit 463B forms space into which an ink replenishing apparatus can be introduced for replenishing with ink the ink bag 402 held between the first housing 411 and the second housing 412. The identification unit 484 is a salient for indicating the color of ink contained in the ink bag 402 of the ink cartridge 38.

Lock nails 486*a*, 486*b*, and 486*c* to which engage units of the first housing 411 engage, are formed monolithically at three corners of the inner wall of the second housing 412. Fitting units 487 and 488, having grooves to which the holding member 422 of the ink bag 402 is fitted, are formed on the inner wall of the second housing 412.

An arc unit 473B corresponding to about a quarter of the opening 473 is formed on the front face of the second housing 412. An engage recess 489 to which, when the third housing 413 is fitted, a lock nail of the third housing 413 is engaged, is formed on the second housing 412.

As shown in FIG. 26, the third housing 413 is fitted to the notch unit 463A and 463B on the front face at the ink supply side of the first housing 411 and the second housing 412 fitted together. Lock nails 491 and 492 that engage the engage recess 479 and 489 of the first housing 411 and the second housing 412, respectively, are formed on the third housing 413. Additionally, an arc unit 473C corresponds to ½ of the opening unit 473.

Figure 40:
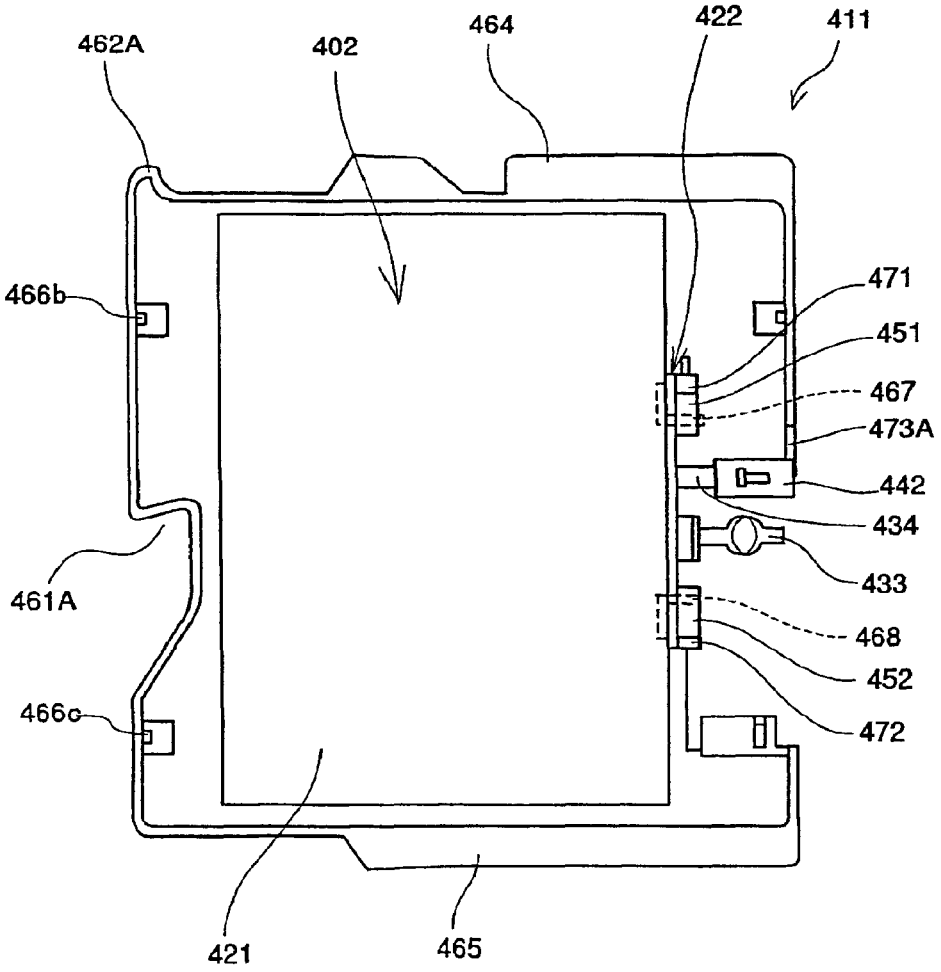
FIG. 40 is a side view of the first housing and the ink bag locked thereto of the ink cartridge.

According to the above structure, as shown in FIG. 40, the holding member 422 of the ink bag 402 is locked to the first housing 411 by pressing the holding member 422 positioned with the positioning units 467 and 468 of the first housing 411 since the lock nails 471 and 472 of the first housing 411 lock the engage salients 451 and 452 of the holding member 422 of the ink bag 402.

Then, the first housing 411 and the second housing 412 are assembled by superposing and pressing them from the outside since the lock nails 486*a*-486*c* of the second housing 412 are hooked to the engage units 466*a*-466*c* of the first housing 411. The assembly (shown in FIG. 26) of the first housing 411 and the second housing 412 is completed.

As shown in FIG. 26, when the third housing 413 is fitted to the first housing 411 and the second housing 412, the lock nails 491 of the third housing 413 are hooked by the engage recesses 479 and 489 of the first housing 411 and the second housing 412. Accordingly, the ink cartridge 38 as shown in FIG. 25 is completed.

An ink cartridge 38 according to yet another embodiment is described below with reference to FIGS. 41 and 26.

Figure 41:
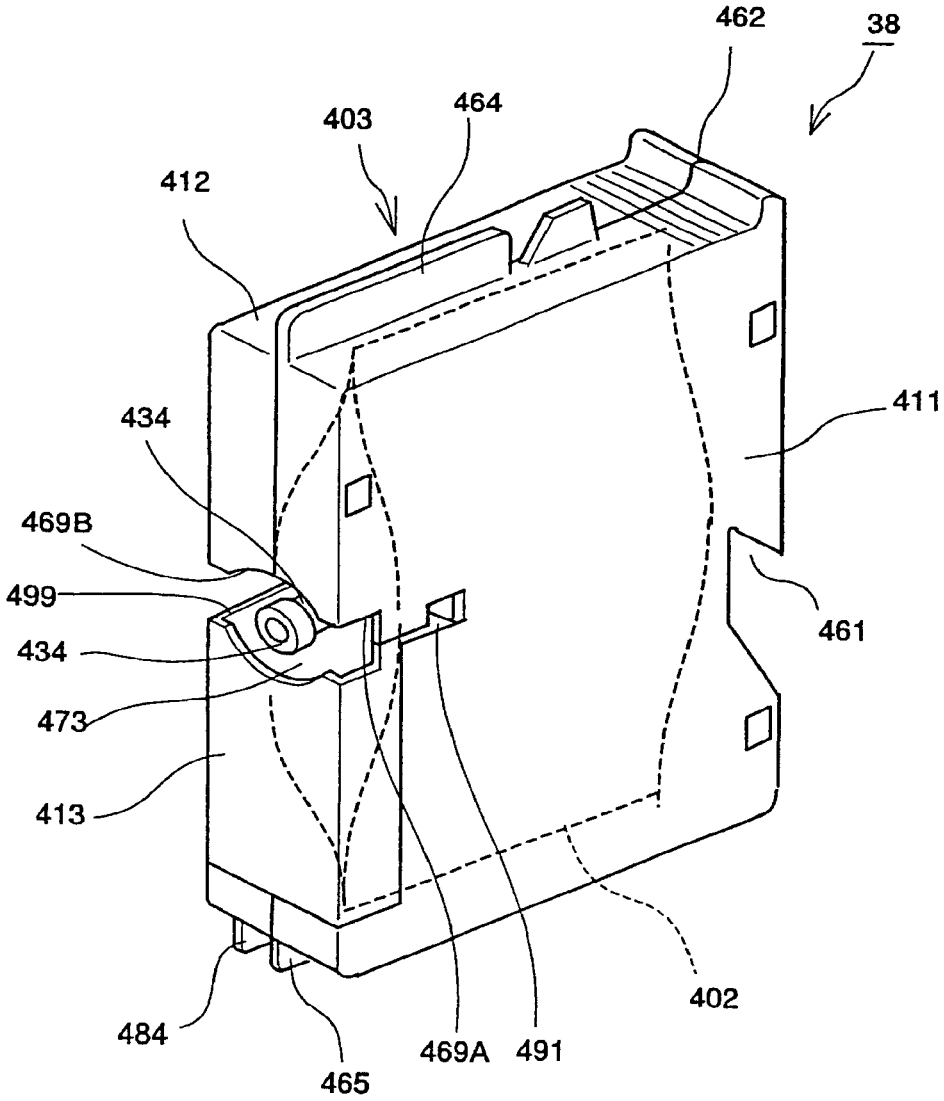
FIG. 41 is a perspective view of an ink cartridge according to another embodiment.

The ink cartridge 38 shown in FIG. 41 includes the ink bag 402, the first housing 411, and the second housing 412. The first housing 411 and the second housing 412 have notch units 469A and 469B, respectively, formed around the ink outlet 434 and the cap member 442 provided at the point of the ink outlet 434 of the ink bag 402. The ink cartridge 38 also includes the third housing 413 having a notch unit 499 formed around the ink outlet 434 and the cap member 442 provided at the point of the ink outlet 434 of the ink bag 402.

Figure 42:
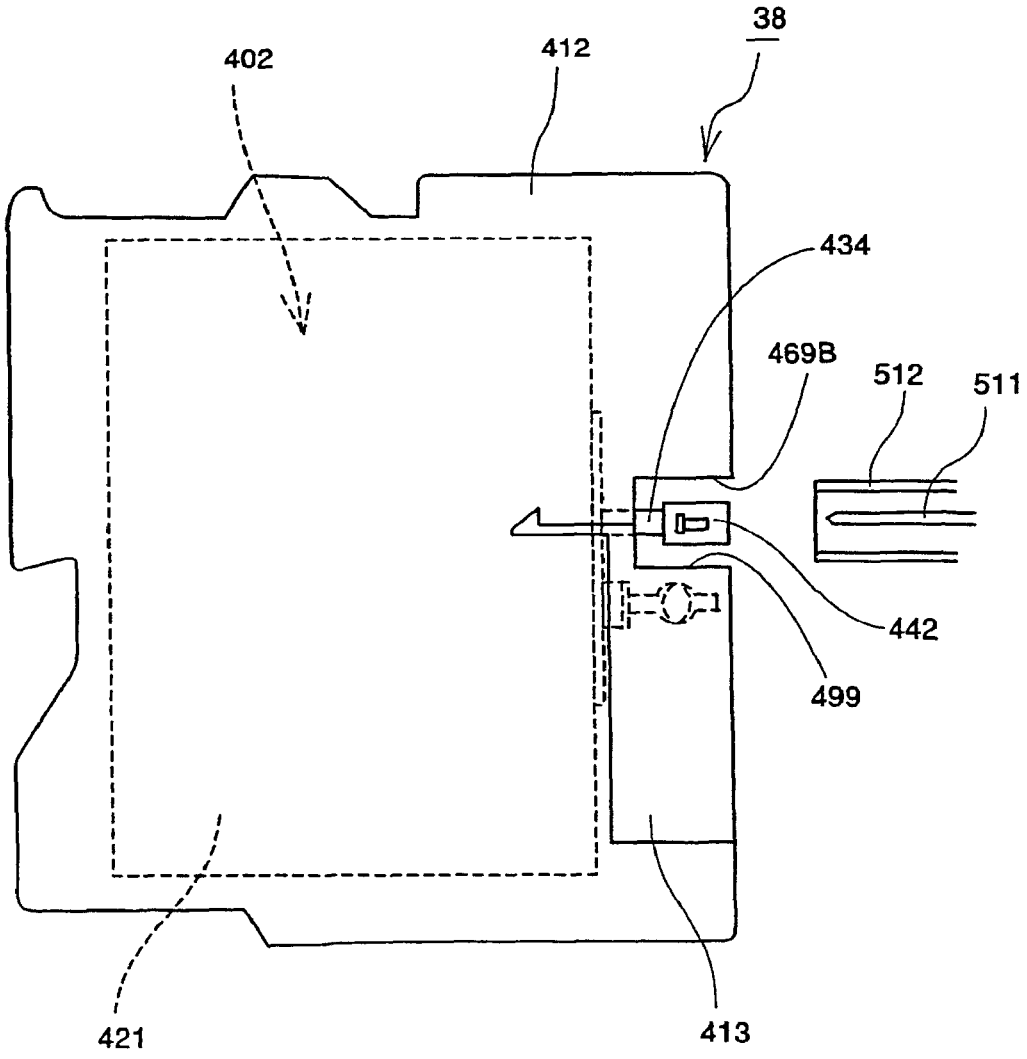
FIG. 42 is a side schematic diagram for explaining the connection between the ink cartridge and the apparatus body.
Figure 43:
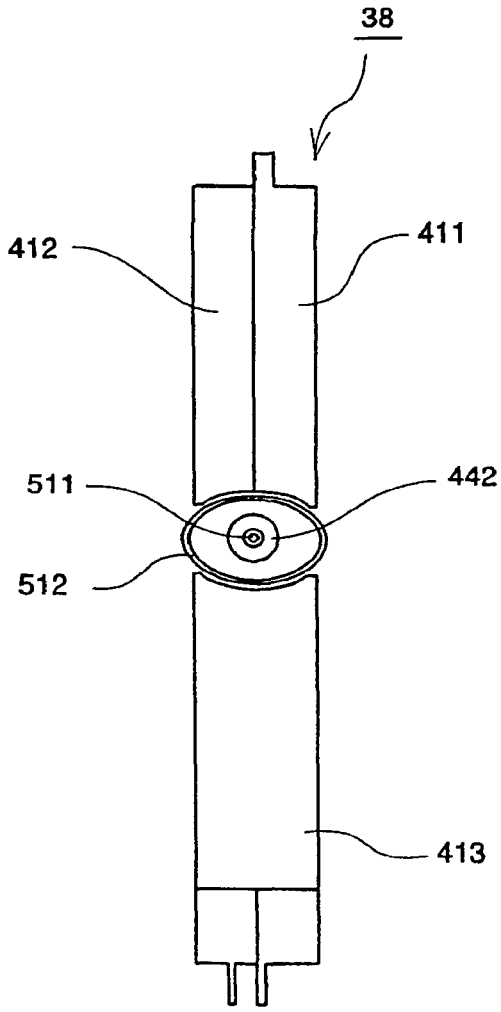
FIG. 43 is a front schematic diagram for explaining the connection between the ink cartridge and the apparatus body.
Figure 44:
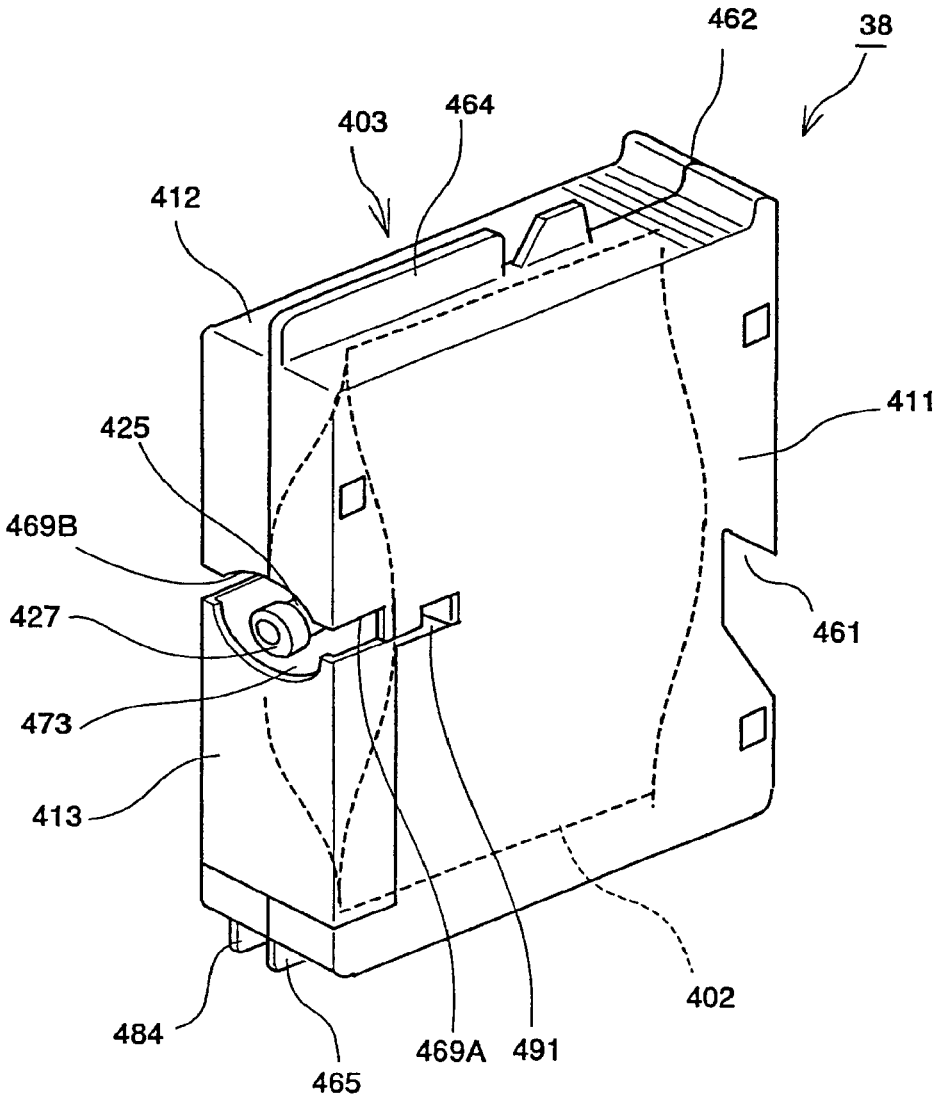
FIG. 44 is a perspective view of an ink cartridge according to yet another embodiment.

As shown in FIG. 42, the ink cartridge 38 is connected to the ink supply system of the apparatus body by inserting a needle 511 from the apparatus body side to the ink outlet unit 434 of the ink cartridge 38. The needle 511 is protected by a needle guard 512. However, when the ink cartridge 38 becomes thin, it is difficult to have enough opening for the needle guard 512 to enter the opening 473. To solve this problem, the notch units are formed beside the ink outlet 434 and the cap member 442 provided at the point of the ink outlet 434 of the ink bag 402, on the housings 411, 412, and 413. According to this arrangement, the needle guard 512 can enter without touching the housings. Thereby, the ink cartridge can be made thinner.

The first housing 411 and the second housing 412 have notch units 469A and 469B, respectively, formed around the ink outlet 434 and/or the cap member 442 provided at the point of the ink outlet 434 of the ink bag 402. The third housing 413, however, has no notch unit.

As described above, since the ink bag 402 is stored in the cartridge housing 403, it is possible to form the thin box-shaped ink cartridge 38. Further, as shown in FIG. 10B, ink is supplied from the ink cartridge 38 to the sub-tank 35 provided on the carriage 33 via the ink supply tube 36. Accordingly, the ink cartridge can be loaded and unloaded to/from the apparatus body by the front operation.

Japanese Patent Laid-Open Application No. 10-202900, for example, discloses a conventional ink cartridge (or ink tank) for supplying ink to a sub-tank, the ink cartridge including a flexible bag-shaped ink tank having the outlet of ink, and a chassis unit (housing) having an opening through which the ink tank can be stored and removed.

When the ink cartridge is loaded to the apparatus body from the top with the ink outlet unit thereof facing down, the ink tank sets well to some extent in the chassis unit. However, if the ink cartridge is loaded to the apparatus body from the front with the ink outlet unit thereof facing horizontally, the ink tank slants in the chassis unit. That is, the conventional ink cartridge does not work in front loading. The ink cartridge according to the present invention can be loaded to and unloaded from the apparatus body from the front (front operation).

Figure 45:
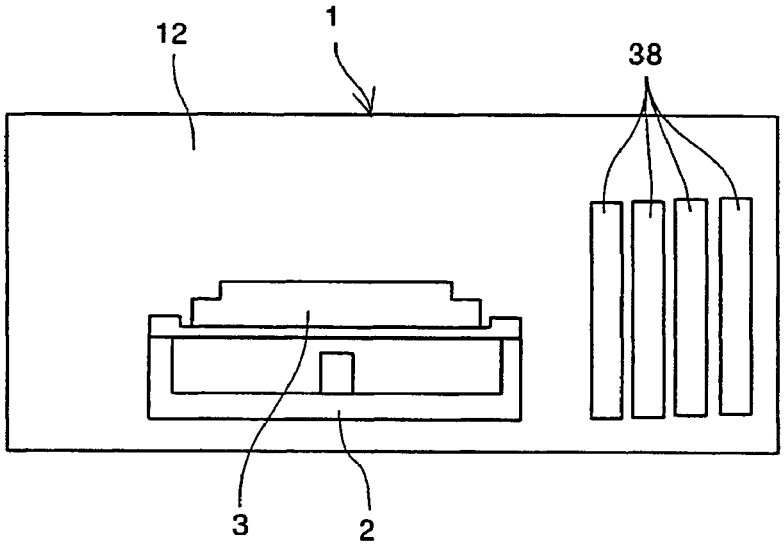
FIG. 45 is a schematic diagram for explaining a disposition of the ink cartridges according to an embodiment.

As shown in FIGS. 2A, 2B, and 45, all ink cartridges 38 corresponding to four respective colors are loaded at the right side of the front face of the recording apparatus body 1. The present invention is not limited to the above embodiment.

Figure 46:
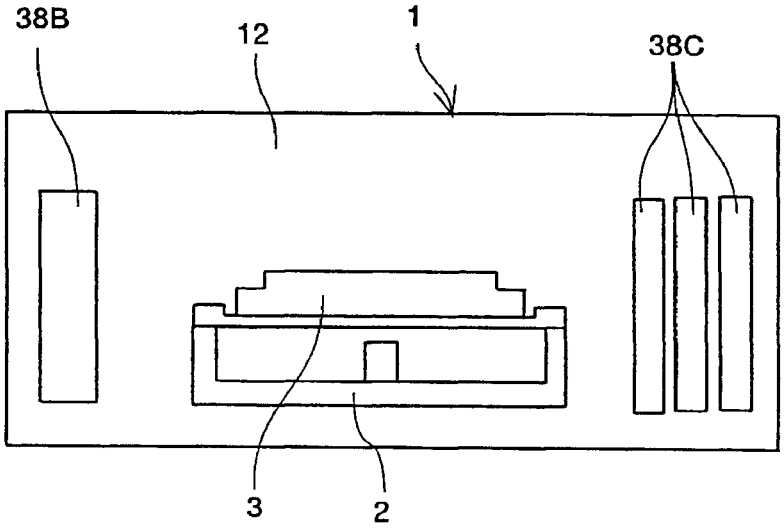
FIG. 46 is a schematic diagram for explaining a disposition of the ink cartridges according to another embodiment.

For example, as shown in FIG. 46, color ink cartridges 38C are disposed at the right side of the apparatus body 1, but black ink cartridge 38B may be disposed at the left side of the apparatus body 1. The higher usage black ink cartridge 38B may be made bigger than the color ink cartridges 38C. A color ink cartridge 38C may be disposed at the left side of the apparatus body 1.

Figure 47:
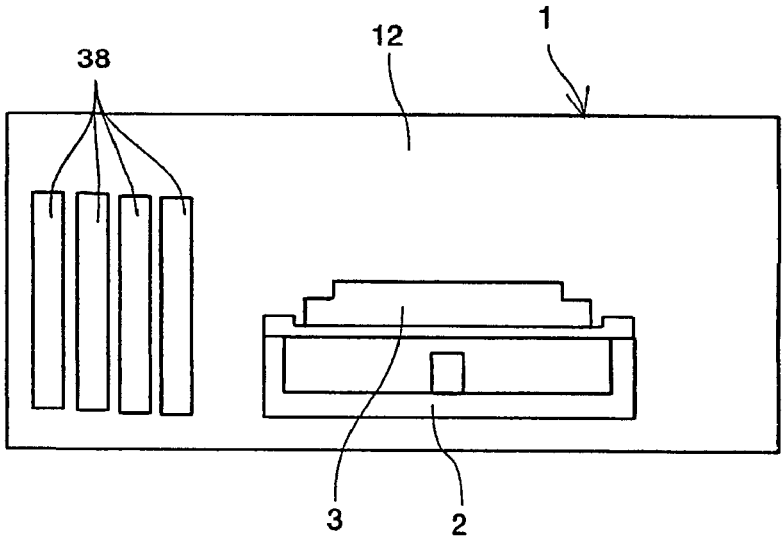
FIG. 47 is a schematic diagram for explaining a disposition of the ink cartridges according to yet another embodiment.
Figure 48:
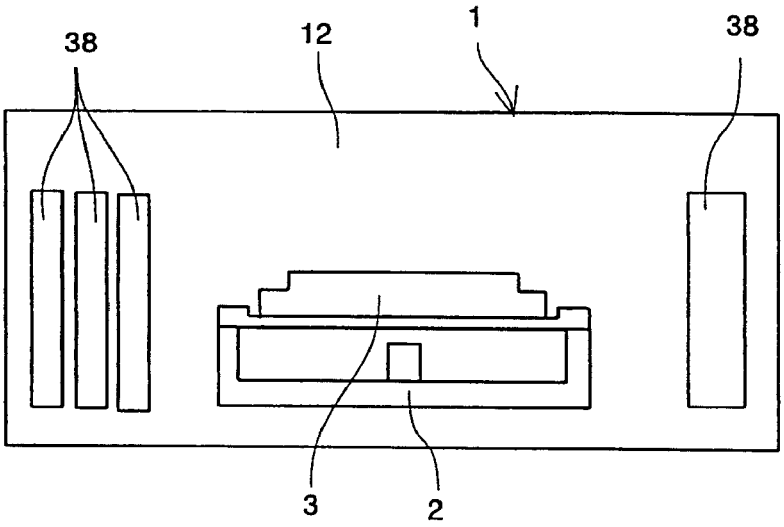
FIG. 48 is a schematic diagram for explaining a disposition of the ink cartridges according to yet another embodiment.
Figure 49:
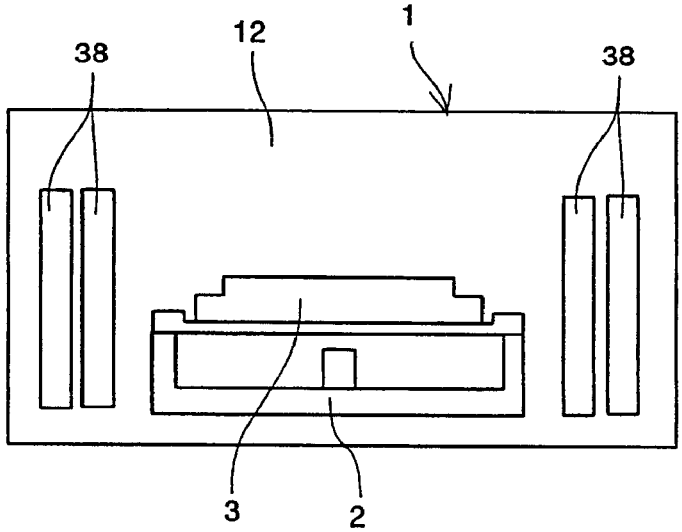
FIG. 49 is a schematic diagram for explaining a disposition of the ink cartridges according to yet another embodiment.

As shown in FIG. 47, the ink cartridges 38 of four colors may be disposed at the left side of the apparatus body 1. Alternatively, as shown in FIG. 48, one of the ink cartridges 38 may be disposed at the right side of the apparatus body 1, and the other ink cartridges 38 may be disposed at the left side of the apparatus body 1. As shown in FIG. 49, two ink cartridges may be disposed at each side of the apparatus body 1. The number of ink cartridges 38 is not limited to four. The number of ink cartridges 38 disposed at the right side of the apparatus body 1 and that of ink cartridges 38 disposed at the left side of the apparatus body 1 may be equal and may be different.

Figure 50:
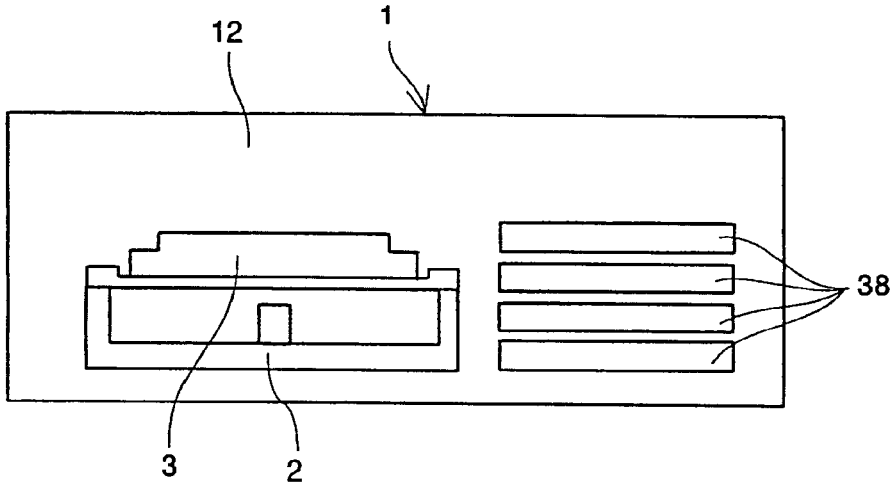
FIG. 50 is a schematic diagram for explaining a disposition of the ink cartridges according to yet another embodiment.
Figure 51:
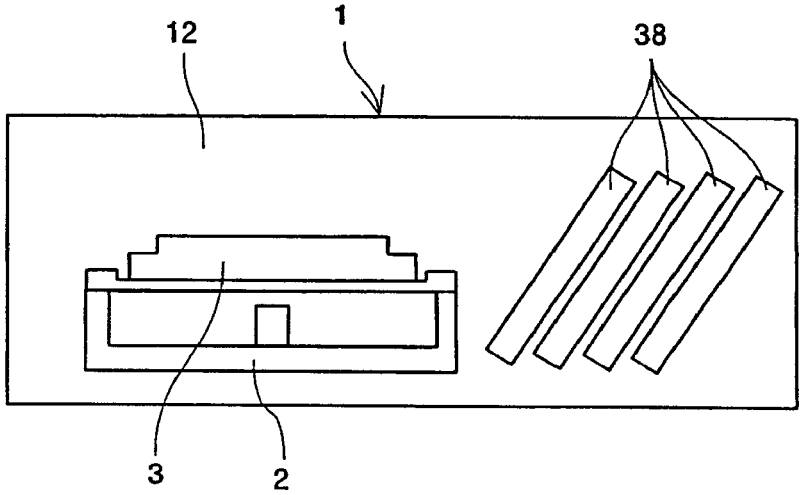
FIG. 51 is a schematic diagram for explaining a disposition of the ink cartridges according to yet another embodiment.

According to the above embodiments, the ink cartridges are assumed to be loaded by sliding it into the loading unit from the front of the apparatus body. The ink cartridges 38, however, may be loaded sideways from the front of the apparatus body 1 as shown in FIG. 50. Additionally, the ink cartridge 38 may be loaded askew from the front of the apparatus body 1. The attitude of the ink cartridges 38 may be determined in accordance with the size and position of members disposed at the front side of the apparatus body 1.

Figure 52:
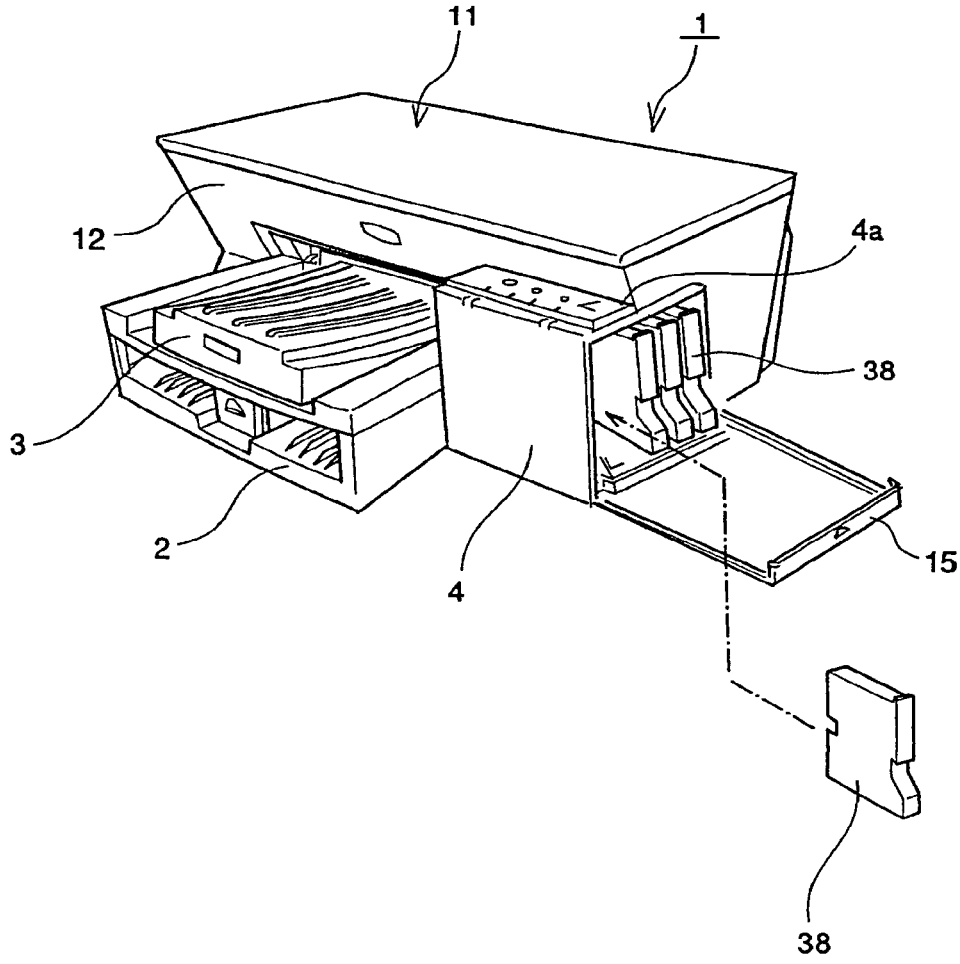
FIG. 52 is a front perspective view of an ink jet recording apparatus according to another embodiment, to which an ink cartridge is loaded from the side.
Figure 53:
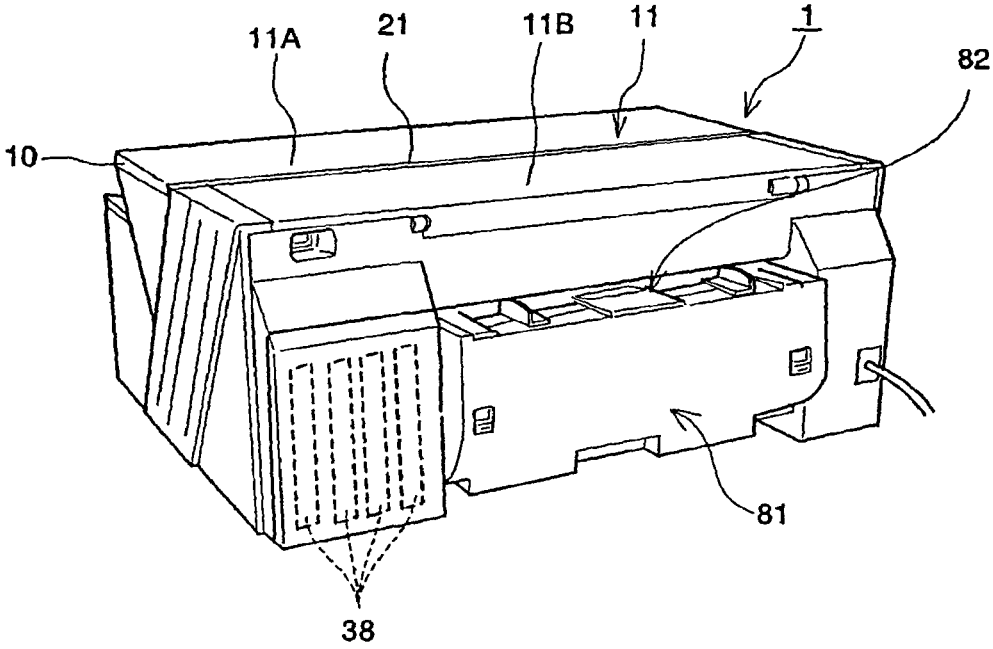
FIG. 53 is a rear perspective view of an ink jet recording apparatus according to yet another embodiment, to which an ink cartridge is loaded from the rear.

According to the present embodiment, as shown in FIGS. 2A and 2B, for example, the ink cartridges 38 are slid and loaded in the apparatus body 1. According to another embodiment, as shown in FIG. 52, the ink cartridge 38 may be slid in the apparatus body 1 from the side of the apparatus body 1, or from the rear of the apparatus body 1. In this case, the ink cartridges 38 may be disposed horizontally or askew as described above.

Figure 54:
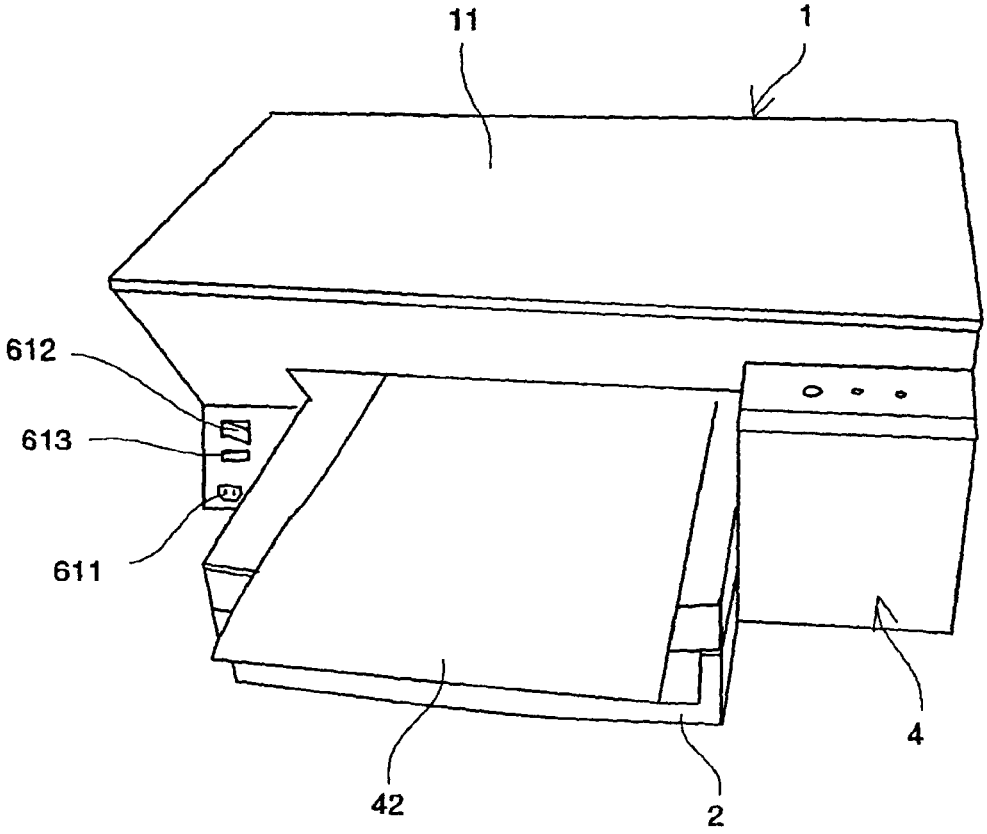
FIG. 54 is a front perspective view of an ink jet recording apparatus according to yet another embodiment, for explaining an exemplary front face thereof.

According to the above embodiment, the paper feed tray 2, the paper discharge tray 3, and the ink cartridges 38 are handled in the front of the apparatus body 1. Additionally, as shown in FIG. 54, a connector 611 to which a power code is to be connected, a power switch 612, and another connector such as a USB connector to which an external device is to be connected may be disposed on the front face 12 of the apparatus body 1 (full front operation) so as to improve the operability of the recording apparatus.

According to the above embodiment, the present invention is applied to a serial type (shuttle type) ink jet recording apparatus in which a carriage scans paper. According to another embodiment, the present invention is applicable to a line type ink jet recording apparatus having a line type head.

The present invention is applicable to not only the ink jet printer but also, for example, a facsimile machine, a copier, and a multifunctional peripheral that serves as a printer, a facsimile machine, and a copier. In addition, the present invention is applicable to an apparatus that discharges liquid other than ink, such as resist and DNA samples.

The present invention is not limited to these embodiments, and variations and modifications may be made without departing from the scope of the present invention.

INDUSTRIAL APPLICABILITY

According to the present invention, a useful compact front-operable image forming apparatus can be provided. The bottom side of the slant front face of the image forming apparatus recedes backward. According to this arrangement, the flat top face can be provided, and simultaneously, enough space for the feeding and discharging of paper can be provided.

The invention claimed is:

1. An image forming apparatus, comprising:

a plurality of recording liquid cartridges configured to contain recording liquids of colors different from each other;

a cartridge holder fixedly formed at a front surface of the image forming apparatus and configured to hold the plurality of recording liquid cartridges in the apparatus;

a cartridge cover provided in a front of the cartridge holder and configured to enclose the plurality of recording liquid cartridges held by the cartridge holder inside the apparatus and to be opened to allow an operator access to attach and detach each of the plurality of recording liquid cartridges to and from the front of the image forming apparatus in a substantially horizontal direction; and a plurality of indicators configured to indicate information relating to each of the corresponding plurality of recording liquid cartridges, and disposed on a top surface of the cartridge holder and disposed at positions corresponding to and above respective positions of the plurality of recording liquid cartridges placed in the cartridge holder.

2. The image forming apparatus according to claim 1, wherein the positions of the plurality of indicators disposed on the top surface of the cartridge holder are offset from the cartridge cover.

3. The image forming apparatus according to claim 1, wherein the plurality of indicators disposed on the top surface of the cartridge holder are offset from the front surface of the image forming apparatus.

4. The image forming apparatus according to claim 1, wherein the cartridge holder includes a control panel to set controls of the image forming apparatus, and the plurality of indicators and a plurality of indexes are formed on the control panel.

5. The image forming apparatus according to claim 1, wherein the plurality of recording liquid cartridges are placed in a portrait orientation and are horizontally aligned in the cartridge holder.

6. The image forming apparatus according to claim 1, wherein the cartridge holder is fixed in the image forming apparatus and is separately provided from a carriage that carries recording heads, the carriage including sub-tanks to receive respective inks from corresponding ones of the recording liquid cartridges in the cartridge holder.

7. The image forming apparatus according to claim 1, further comprising a paper tray and an output tray, wherein the paper tray and the output tray are provided on the front of the image forming apparatus, the output tray is provided above the paper tray, and the cartridge holder is provided adjacent to the paper tray and the output tray and near one side of the image forming apparatus.

* * * * *